US008299695B2

(12) United States Patent
Simon et al.

(10) Patent No.: US 8,299,695 B2
(45) Date of Patent: Oct. 30, 2012

(54) SCREW-IN LED BULB COMPRISING A BASE HAVING OUTWARDLY PROJECTING NODES

(75) Inventors: David L. Simon, Grosse Pointe Woods, MI (US); John Ivey, Farmington Hills, MI (US); Michael A. White, Beverly Hills, MI (US)

(73) Assignee: ilumisys, Inc., Troy, MI (US)

( * ) Notice: Subject to any disclaimer, the term of this patent is extended or adjusted under 35 U.S.C. 154(b) by 23 days.

(21) Appl. No.: 12/791,122

(22) Filed: Jun. 1, 2010

(65) Prior Publication Data

US 2010/0301729 A1 Dec. 2, 2010

Related U.S. Application Data

(60) Provisional application No. 61/183,307, filed on Jun. 2, 2009.

(51) Int. Cl.

| | |
|---|---|
| ***H01J 7/26*** | (2006.01) |
| ***H01J 7/24*** | (2006.01) |
| ***H01J 5/50*** | (2006.01) |
| ***H01J 5/54*** | (2006.01) |

(52) U.S. Cl. ..... 313/318.01; 313/318.05; 313/44; 313/45; 362/249.02; 362/294

(58) Field of Classification Search ..... 313/498–512, 313/317–318.01, 318.12, 39–47; 362/294, 362/249.02

See application file for complete search history.

(56) References Cited

U.S. PATENT DOCUMENTS

| | | | |
|---|---|---|---|
| D54,511 | S | 2/1920 | Owen |
| D58,105 | S | 6/1921 | Poritz |
| D79,814 | S | 8/1929 | Hoch |
| D80,419 | S | 1/1930 | Kramer |
| D84,763 | S | 7/1931 | Stange |
| D119,797 | S | 4/1940 | Winkler et al. |
| D125,312 | S | 2/1941 | Logan |
| 2,909,097 | A | 10/1959 | Alden et al. |
| 3,318,185 | A | 5/1967 | Kott |

(Continued)

FOREIGN PATENT DOCUMENTS

| | | | |
|---|---|---|---|
| CN | 1584388 | A | 2/2005 |

(Continued)

OTHER PUBLICATIONS

Wolsey, Robert. Interoperable Systems: The Future of Lighting Control, Lighting Research Center, Jan. 1, 1997, vol. 2 No. 2, Rensselaer Polytechnic Institute, Troy, New York [online]. Retrieved Lighting Research Center Web Page using Internet <URL: http://www.lrc.rpi.edu/programs/Futures/LF-BAS/index.asp>.

(Continued)

*Primary Examiner* — Mariceli Santiago

(74) *Attorney, Agent, or Firm* — Young Basile

(57) ABSTRACT

An LED-based light can include a highly thermally conductive base having multiple radially outward projecting nodes. The nodes can be spaced apart in an axial and circumferential directions of the base. An electrical connector and at least one LED can be attached to the base, and a light transmitting bulb can be attached to the base and can cover the at least one LED. The geometry of the base can promote heat dissipation, which can allow the at least one LED to use enough power to produce an amount of luminosity that allows the LED-based light to replicate, for example, an incandescent light without overheating.

27 Claims, 4 Drawing Sheets

U.S. PATENT DOCUMENTS

| | | | |
|---|---|---|---|
| 3,561,719 | A | 2/1971 | Grindle |
| 3,586,936 | A | 6/1971 | McLeroy |
| 3,601,621 | A | 8/1971 | Ritchie |
| 3,612,855 | A | 10/1971 | Juhnke |
| 3,643,088 | A | 2/1972 | Osteen et al. |
| 3,746,918 | A | 7/1973 | Drucker et al. |
| 3,818,216 | A | 6/1974 | Larraburu |
| 3,832,503 | A | 8/1974 | Crane |
| 3,858,086 | A | 12/1974 | Anderson et al. |
| 3,909,670 | A | 9/1975 | Wakamatsu et al. |
| 3,924,120 | A | 12/1975 | Cox, III |
| 3,958,885 | A | 5/1976 | Stockinger et al. |
| 3,974,637 | A | 8/1976 | Bergey et al. |
| 3,993,386 | A | 11/1976 | Rowe |
| 4,001,571 | A | 1/1977 | Martin |
| 4,054,814 | A | 10/1977 | Fegley et al. |
| 4,070,568 | A | 1/1978 | Gala |
| 4,082,395 | A | 4/1978 | Donato et al. |
| 4,096,349 | A | 6/1978 | Donato |
| 4,102,558 | A | 7/1978 | Krachman |
| 4,107,581 | A | 8/1978 | Abernethy |
| 4,189,663 | A | 2/1980 | Schmutzer et al. |
| 4,211,955 | A | 7/1980 | Ray |
| 4,241,295 | A | 12/1980 | Williams, Jr. |
| 4,271,408 | A | 6/1981 | Teshima et al. |
| 4,272,689 | A | 6/1981 | Crosby et al. |
| 4,273,999 | A | 6/1981 | Pierpoint |
| 4,298,869 | A | 11/1981 | Okuno |
| 4,329,625 | A | 5/1982 | Nishizawa et al. |
| 4,339,788 | A | 7/1982 | White et al. |
| 4,342,947 | A | 8/1982 | Bloyd |
| 4,367,464 | A | 1/1983 | Kurahashi et al. |
| D268,134 | S | 3/1983 | Zurcher |
| 4,382,272 | A | 5/1983 | Quella et al. |
| 4,388,567 | A | 6/1983 | Yamazaki et al. |
| 4,388,589 | A | 6/1983 | Molldrem, Jr. |
| 4,392,187 | A | 7/1983 | Bornhorst |
| 4,394,719 | A | 7/1983 | Moberg |
| 4,420,711 | A | 12/1983 | Takahashi et al. |
| 4,455,562 | A | 6/1984 | Dolan et al. |
| 4,500,796 | A | 2/1985 | Quin |
| 4,581,687 | A | 4/1986 | Nakanishi |
| 4,597,033 | A | 6/1986 | Meggs et al. |
| 4,600,972 | A | 7/1986 | MacIntyre |
| 4,607,317 | A | 8/1986 | Lin |
| 4,622,881 | A | 11/1986 | Rand |
| 4,625,152 | A | 11/1986 | Nakai |
| 4,635,052 | A | 1/1987 | Aoike et al. |
| 4,647,217 | A | 3/1987 | Havel |
| 4,656,398 | A | 4/1987 | Michael et al. |
| 4,661,890 | A | 4/1987 | Watanabe et al. |
| 4,668,895 | A | 5/1987 | Schneiter |
| 4,675,575 | A | 6/1987 | Smith et al. |
| 4,682,079 | A | 7/1987 | Sanders et al. |
| 4,686,425 | A | 8/1987 | Havel |
| 4,687,340 | A | 8/1987 | Havel |
| 4,688,154 | A | 8/1987 | Nilssen |
| 4,688,869 | A | 8/1987 | Kelly |
| 4,695,769 | A | 9/1987 | Schweickardt |
| 4,698,730 | A | 10/1987 | Sakai et al. |
| 4,701,669 | A | 10/1987 | Head et al. |
| 4,705,406 | A | 11/1987 | Havel |
| 4,707,141 | A | 11/1987 | Havel |
| D293,723 | S | 1/1988 | Buttner |
| 4,727,289 | A | 2/1988 | Uchida |
| 4,740,882 | A | 4/1988 | Miller |
| 4,748,545 | A | 5/1988 | Schmitt |
| 4,753,148 | A | 6/1988 | Johnson |
| 4,758,173 | A | 7/1988 | Northrop |
| 4,771,274 | A | 9/1988 | Havel |
| 4,780,621 | A | 10/1988 | Bartleucci et al. |
| 4,794,383 | A | 12/1988 | Havel |
| 4,810,937 | A | 3/1989 | Havel |
| 4,818,072 | A | 4/1989 | Mohebban |
| 4,824,269 | A | 4/1989 | Havel |
| 4,837,565 | A | 6/1989 | White |
| 4,843,627 | A | 6/1989 | Stebbins |
| 4,845,481 | A | 7/1989 | Havel |
| 4,845,745 | A | 7/1989 | Havel |
| 4,857,801 | A | 8/1989 | Farrell |
| 4,863,223 | A | 9/1989 | Weissenbach et al. |
| 4,870,325 | A | 9/1989 | Kazar |
| 4,874,320 | A | 10/1989 | Freed et al. |
| 4,887,074 | A | 12/1989 | Simon et al. |
| 4,894,832 | A | 1/1990 | Colak |
| 4,901,207 | A | 2/1990 | Sato et al. |
| 4,912,371 | A | 3/1990 | Hamilton |
| 4,922,154 | A | 5/1990 | Cacoub |
| 4,934,852 | A | 6/1990 | Havel |
| 4,941,072 | A | 7/1990 | Yasumoto et al. |
| 4,943,900 | A | 7/1990 | Gartner |
| 4,962,687 | A | 10/1990 | Belliveau et al. |
| 4,965,561 | A | 10/1990 | Havel |
| 4,973,835 | A | 11/1990 | Kurosu et al. |
| 4,979,081 | A | 12/1990 | Leach et al. |
| 4,980,806 | A | 12/1990 | Taylor et al. |
| 4,992,704 | A | 2/1991 | Stinson |
| 5,003,227 | A | 3/1991 | Nilssen |
| 5,008,595 | A | 4/1991 | Kazar |
| 5,008,788 | A | 4/1991 | Palinkas |
| 5,010,459 | A | 4/1991 | Taylor et al. |
| 5,018,054 | A | 5/1991 | Ohashi et al. |
| 5,027,037 | A | 6/1991 | Wei |
| 5,027,262 | A | 6/1991 | Freed |
| 5,032,960 | A | 7/1991 | Katoh |
| 5,034,807 | A | 7/1991 | Von Kohorn |
| 5,036,248 | A | 7/1991 | McEwan et al. |
| 5,038,255 | A | 8/1991 | Nishihashi et al. |
| 5,065,226 | A | 11/1991 | Kluitmans et al. |
| 5,072,216 | A | 12/1991 | Grange |
| 5,078,039 | A | 1/1992 | Tulk et al. |
| 5,083,063 | A | 1/1992 | Brooks |
| 5,088,013 | A | 2/1992 | Revis |
| 5,089,748 | A | 2/1992 | Ihms |
| 5,103,382 | A | 4/1992 | Kondo et al. |
| 5,122,733 | A | 6/1992 | Havel |
| 5,126,634 | A | 6/1992 | Johnson |
| 5,128,595 | A | 7/1992 | Hara |
| 5,130,909 | A | 7/1992 | Gross |
| 5,134,387 | A | 7/1992 | Smith et al. |
| 5,140,220 | A | 8/1992 | Hasegawa |
| 5,142,199 | A | 8/1992 | Elwell |
| 5,151,679 | A | 9/1992 | Dimmick |
| 5,154,641 | A | 10/1992 | McLaughlin |
| 5,161,879 | A | 11/1992 | McDermott |
| 5,161,882 | A | 11/1992 | Garrett |
| 5,164,715 | A | 11/1992 | Kashiwabara et al. |
| 5,184,114 | A | 2/1993 | Brown |
| 5,194,854 | A | 3/1993 | Havel |
| 5,198,756 | A | 3/1993 | Jenkins et al. |
| 5,209,560 | A | 5/1993 | Taylor et al. |
| 5,220,250 | A | 6/1993 | Szuba |
| 5,225,765 | A | 7/1993 | Callahan et al. |
| 5,226,723 | A | 7/1993 | Chen |
| 5,254,910 | A | 10/1993 | Yang |
| 5,256,948 | A | 10/1993 | Boldin et al. |
| 5,278,542 | A | 1/1994 | Smith et al. |
| 5,282,121 | A | 1/1994 | Bornhorst et al. |
| 5,283,517 | A | 2/1994 | Havel |
| 5,287,352 | A | 2/1994 | Jackson et al. |
| 5,294,865 | A | 3/1994 | Haraden |
| 5,298,871 | A | 3/1994 | Shimohara |
| 5,301,090 | A | 4/1994 | Hed |
| 5,303,124 | A | 4/1994 | Wrobel |
| 5,307,295 | A | 4/1994 | Taylor et al. |
| 5,321,593 | A | 6/1994 | Moates |
| 5,323,226 | A | 6/1994 | Schreder |
| 5,329,431 | A | 7/1994 | Taylor et al. |
| 5,344,068 | A | 9/1994 | Haessig |
| 5,350,977 | A | 9/1994 | Hamamoto et al. |
| 5,357,170 | A | 10/1994 | Luchaco et al. |
| 5,371,618 | A | 12/1994 | Tai et al. |
| 5,374,876 | A | 12/1994 | Horibata et al. |
| 5,375,043 | A | 12/1994 | Tokunaga |
| D354,360 | S | 1/1995 | Murata |
| 5,381,074 | A | 1/1995 | Rudzewicz et al. |
| 5,388,357 | A | 2/1995 | Malita |

5,402,702 A 4/1995 Hata
5,404,282 A 4/1995 Klinke et al.
5,406,176 A 4/1995 Sugden
5,410,328 A 4/1995 Yoksza et al.
5,412,284 A 5/1995 Moore et al.
5,412,552 A 5/1995 Fernandes
5,420,482 A 5/1995 Phares
5,421,059 A 6/1995 Leffers, Jr.
5,430,356 A 7/1995 Ference et al.
5,432,408 A 7/1995 Matsuda et al.
5,436,535 A 7/1995 Yang
5,436,853 A 7/1995 Shimohara
5,450,301 A 9/1995 Waltz et al.
5,461,188 A 10/1995 Drago et al.
5,463,280 A 10/1995 Johnson
5,463,502 A 10/1995 Savage, Jr.
5,465,144 A 11/1995 Parker et al.
5,475,300 A 12/1995 Havel
5,489,827 A 2/1996 Xia
5,491,402 A 2/1996 Small
5,493,183 A 2/1996 Kimball
5,504,395 A 4/1996 Johnson et al.
5,506,760 A 4/1996 Giebler et al.
5,513,082 A 4/1996 Asano
5,519,496 A 5/1996 Borgert et al.
5,530,322 A 6/1996 Ference et al.
5,544,809 A 8/1996 Keating et al.
5,545,950 A 8/1996 Cho
5,550,440 A 8/1996 Allison et al.
5,559,681 A 9/1996 Duarte
5,561,346 A 10/1996 Byrne
D376,030 S 11/1996 Cohen
5,575,459 A 11/1996 Anderson
5,575,554 A 11/1996 Guritz
5,581,158 A 12/1996 Quazi
5,592,051 A 1/1997 Korkala
5,592,054 A 1/1997 Nerone et al.
5,600,199 A 2/1997 Martin, Sr. et al.
5,607,227 A 3/1997 Yasumoto et al.
5,608,290 A 3/1997 Hutchisson et al.
5,614,788 A 3/1997 Mullins et al.
5,621,282 A 4/1997 Haskell
5,621,603 A 4/1997 Adamec et al.
5,621,662 A 4/1997 Humphries et al.
5,622,423 A 4/1997 Lee
5,633,629 A 5/1997 Hochstein
5,634,711 A 6/1997 Kennedy et al.
5,640,061 A 6/1997 Bornhorst et al.
5,640,141 A 6/1997 Myllymaki
5,642,129 A 6/1997 Zavracky et al.
5,655,830 A 8/1997 Ruskouski
5,656,935 A 8/1997 Havel
5,661,374 A 8/1997 Cassidy et al.
5,661,645 A 8/1997 Hochstein
5,673,059 A 9/1997 Zavracky et al.
5,682,103 A 10/1997 Burrell
5,688,042 A 11/1997 Madadi et al.
5,697,695 A 12/1997 Lin et al.
5,701,058 A 12/1997 Roth
5,712,650 A 1/1998 Barlow
5,721,471 A 2/1998 Begemann et al.
5,725,148 A 3/1998 Hartman
5,726,535 A 3/1998 Yan
5,731,759 A 3/1998 Finucan
5,734,590 A 3/1998 Tebbe
5,751,118 A 5/1998 Mortimer
5,752,766 A 5/1998 Bailey et al.
5,765,940 A 6/1998 Levy et al.
5,769,527 A 6/1998 Taylor et al.
5,784,006 A 7/1998 Hochstein
5,785,227 A 7/1998 Akiba
5,790,329 A 8/1998 Klaus et al.
5,803,579 A 9/1998 Turnbull et al.
5,803,580 A 9/1998 Tseng
5,803,729 A 9/1998 Tsimerman
5,806,965 A 9/1998 Deese
5,808,689 A 9/1998 Small
5,810,463 A 9/1998 Kawahara et al.
5,812,105 A 9/1998 Van de Ven
5,813,751 A 9/1998 Shaffer
5,813,753 A 9/1998 Vriens et al.
5,821,695 A 10/1998 Vilanilam et al.
5,825,051 A 10/1998 Bauer et al.
5,828,178 A 10/1998 York et al.
5,836,676 A 11/1998 Ando et al.
5,848,837 A 12/1998 Gustafson
5,850,126 A 12/1998 Kanbar
5,851,063 A 12/1998 Doughty et al.
5,852,658 A 12/1998 Knight et al.
5,854,542 A 12/1998 Forbes
RE36,030 E 1/1999 Nadeau
5,859,508 A 1/1999 Ge et al.
5,865,529 A 2/1999 Yan
5,890,794 A 4/1999 Abtahi et al.
5,896,010 A 4/1999 Mikolajczak et al.
5,907,742 A 5/1999 Johnson et al.
5,912,653 A 6/1999 Fitch
5,921,660 A 7/1999 Yu
5,924,784 A 7/1999 Chliwnyj et al.
5,927,845 A 7/1999 Gustafson et al.
5,934,792 A 8/1999 Camarota
5,943,802 A 8/1999 Tijanic
5,946,209 A 8/1999 Eckel et al.
5,949,347 A 9/1999 Wu
5,952,680 A 9/1999 Strite
5,959,547 A 9/1999 Tubel et al.
5,962,989 A 10/1999 Baker
5,962,992 A 10/1999 Huang et al.
5,963,185 A 10/1999 Havel
5,974,553 A 10/1999 Gandar
5,980,064 A 11/1999 Metroyanis
5,998,925 A 12/1999 Shimizu et al.
5,998,928 A 12/1999 Hipp
6,007,209 A 12/1999 Pelka
6,008,783 A 12/1999 Kitagawa et al.
6,011,691 A 1/2000 Schreffler
6,016,038 A 1/2000 Mueller et al.
6,018,237 A 1/2000 Havel
6,019,493 A 2/2000 Kuo et al.
6,020,825 A 2/2000 Chansky et al.
6,025,550 A 2/2000 Kato
6,028,694 A 2/2000 Schmidt
6,030,099 A 2/2000 McDermott
6,031,343 A 2/2000 Recknagel et al.
D422,737 S 4/2000 Orozco
6,056,420 A 5/2000 Wilson et al.
6,068,383 A 5/2000 Robertson et al.
6,069,597 A 5/2000 Hansen
6,072,280 A 6/2000 Allen
6,084,359 A 7/2000 Hetzel et al.
6,086,220 A 7/2000 Lash et al.
6,091,200 A 7/2000 Lenz
6,092,915 A 7/2000 Rensch
6,095,661 A 8/2000 Lebens et al.
6,097,352 A 8/2000 Zavracky et al.
6,116,748 A 9/2000 George
6,121,875 A 9/2000 Hamm et al.
6,127,783 A 10/2000 Pashley et al.
6,132,072 A 10/2000 Turnbull et al.
6,135,604 A 10/2000 Lin
6,139,174 A 10/2000 Butterworth
6,149,283 A 11/2000 Conway et al.
6,150,774 A 11/2000 Mueller et al.
6,151,529 A 11/2000 Batko
6,153,985 A 11/2000 Grossman
6,158,882 A 12/2000 Bischoff, Jr.
6,166,496 A 12/2000 Lys et al.
6,175,201 B1 1/2001 Sid
6,175,220 B1 1/2001 Billig et al.
6,181,126 B1 1/2001 Havel
6,183,086 B1 2/2001 Neubert
6,183,104 B1 2/2001 Ferrara
6,184,628 B1 2/2001 Ruthenberg
6,196,471 B1 3/2001 Ruthenberg
6,203,180 B1 3/2001 Fleischmann
6,211,626 B1 4/2001 Lys et al.
6,215,409 B1 4/2001 Blach
6,217,190 B1 4/2001 Altman et al.

6,219,239 B1 4/2001 Mellberg et al.
6,227,679 B1 5/2001 Zhang et al.
6,238,075 B1 5/2001 Dealey, Jr. et al.
6,241,359 B1 6/2001 Lin
6,250,774 B1 6/2001 Begemann et al.
6,252,350 B1 6/2001 Alvarez
6,252,358 B1 6/2001 Xydis et al.
6,268,600 B1 7/2001 Nakamura et al.
6,273,338 B1 8/2001 White
6,275,397 B1 8/2001 McClain
6,283,612 B1 9/2001 Hunter
6,292,901 B1 9/2001 Lys et al.
6,293,684 B1 9/2001 Riblett
6,297,724 B1 10/2001 Bryans et al.
6,305,109 B1 10/2001 Lee
6,305,821 B1 10/2001 Hsieh et al.
6,307,331 B1 10/2001 Bonasia et al.
6,310,590 B1 10/2001 Havel
6,323,832 B1 11/2001 Nishizawa et al.
6,325,651 B1 12/2001 Nishihara et al.
6,334,699 B1 1/2002 Gladnick
6,340,868 B1 1/2002 Lys et al.
6,354,714 B1 3/2002 Rhodes
6,361,186 B1 3/2002 Slayden
6,369,525 B1 4/2002 Chang et al.
6,371,637 B1 4/2002 Atchinson et al.
6,379,022 B1 4/2002 Amerson et al.
D457,667 S 5/2002 Piepgras et al.
D457,669 S 5/2002 Piepgras et al.
D457,974 S 5/2002 Piepgras et al.
6,388,393 B1 5/2002 Illingworth
6,394,623 B1 5/2002 Tsui
D458,395 S 6/2002 Piepgras et al.
6,400,096 B1 6/2002 Wells et al.
6,404,131 B1 6/2002 Kawano et al.
6,411,022 B1 6/2002 Machida
6,422,716 B2 7/2002 Henrici et al.
6,428,189 B1 8/2002 Hochstein
D463,610 S 9/2002 Piepgras et al.
6,445,139 B1 9/2002 Marshall et al.
6,448,550 B1 9/2002 Nishimura
6,448,716 B1 9/2002 Hutchison
6,459,919 B1 10/2002 Lys et al.
6,469,457 B2 10/2002 Callahan
6,471,388 B1 10/2002 Marsh
6,472,823 B2 10/2002 Yen
6,473,002 B1 10/2002 Hutchison
D468,035 S 12/2002 Blanc et al.
6,488,392 B1 12/2002 Lu
6,495,964 B1 12/2002 Muthu et al.
6,527,411 B1 3/2003 Sayers
6,528,954 B1 3/2003 Lys et al.
6,528,958 B2 3/2003 Hulshof et al.
6,538,375 B1 3/2003 Duggal et al.
6,548,967 B1 4/2003 Dowling et al.
6,568,834 B1 5/2003 Scianna
6,573,536 B1 6/2003 Dry
6,577,072 B2 6/2003 Saito et al.
6,577,080 B2 6/2003 Lys et al.
6,577,512 B2 6/2003 Tripathi et al.
6,577,794 B1 6/2003 Currie et al.
6,578,979 B2 6/2003 Truttmann-Battig
6,582,103 B1 6/2003 Popovich et al.
6,583,550 B2 6/2003 Iwasa et al.
6,583,573 B2 6/2003 Bierman
6,585,393 B1 7/2003 Brandes et al.
6,586,890 B2 7/2003 Min et al.
6,590,343 B2 7/2003 Pederson
6,592,238 B2 7/2003 Cleaver et al.
6,596,977 B2 7/2003 Muthu et al.
6,598,996 B1 7/2003 Lodhie
6,608,453 B2 8/2003 Morgan et al.
6,608,614 B1 8/2003 Johnson
6,609,804 B2 8/2003 Nolan et al.
6,612,712 B2 9/2003 Nepil
6,612,717 B2 9/2003 Yen
6,621,222 B1 9/2003 Hong
6,623,151 B2 9/2003 Pederson
6,624,597 B2 9/2003 Dowling et al.
D481,484 S 10/2003 Cuevas et al.
6,634,770 B2 10/2003 Cao
6,634,779 B2 10/2003 Reed
6,636,003 B2 10/2003 Rahm et al.
6,639,349 B1 10/2003 Bahadur
6,641,284 B2 11/2003 Stopa et al.
6,659,622 B2 12/2003 Katogi et al.
6,660,935 B2 12/2003 Southard et al.
6,666,689 B1 12/2003 Savage, Jr.
6,667,623 B2 12/2003 Bourgault et al.
6,674,096 B2 1/2004 Sommers
6,676,284 B1 1/2004 Wynne Willson
6,679,621 B2 1/2004 West et al.
6,681,154 B2 1/2004 Nierlich et al.
6,682,205 B2 1/2004 Lin
6,683,419 B2 1/2004 Kriparos
6,700,136 B2 3/2004 Guida
6,712,486 B1 3/2004 Popovich et al.
6,717,376 B2 4/2004 Lys et al.
6,717,526 B2 4/2004 Martineau et al.
6,720,745 B2 4/2004 Lys et al.
6,726,348 B2 4/2004 Gloisten
6,741,324 B1 5/2004 Kim
D491,678 S 6/2004 Piepgras
D492,042 S 6/2004 Piepgras
6,744,223 B2 6/2004 Laflamme et al.
6,748,299 B1 6/2004 Motoyama
6,762,562 B2 7/2004 Leong
6,774,584 B2 8/2004 Lys et al.
6,777,891 B2 8/2004 Lys et al.
6,781,329 B2 8/2004 Mueller et al.
6,787,999 B2 9/2004 Stimac et al.
6,788,000 B2 9/2004 Appelberg et al.
6,788,011 B2 9/2004 Mueller et al.
6,791,840 B2 9/2004 Chun
6,796,680 B1 9/2004 Showers et al.
6,799,864 B2 * 10/2004 Bohler et al. ..... 362/236
6,801,003 B2 10/2004 Schanberger et al.
6,803,732 B2 10/2004 Kraus et al.
6,806,659 B1 10/2004 Mueller et al.
6,814,470 B2 11/2004 Rizkin et al.
6,815,724 B2 11/2004 Dry
6,846,094 B2 1/2005 Luk
6,851,816 B2 2/2005 Wu et al.
6,851,832 B2 2/2005 Tieszen
6,853,150 B2 2/2005 Clauberg et al.
6,853,151 B2 2/2005 Leong et al.
6,853,563 B1 2/2005 Yang et al.
6,857,924 B2 2/2005 Fu et al.
6,860,628 B2 3/2005 Robertson et al.
6,866,401 B2 3/2005 Sommers et al.
6,869,204 B2 3/2005 Morgan et al.
6,871,981 B2 3/2005 Alexanderson et al.
6,874,924 B1 4/2005 Hulse et al.
6,879,883 B1 4/2005 Motoyama
6,882,111 B2 4/2005 Kan et al.
6,883,929 B2 4/2005 Dowling
6,883,934 B2 4/2005 Kawakami et al.
6,888,322 B2 5/2005 Dowling et al.
6,897,624 B2 5/2005 Lys et al.
6,909,239 B2 6/2005 Gauna
6,909,921 B1 6/2005 Bilger
6,918,680 B2 7/2005 Seeberger
6,921,181 B2 7/2005 Yen
6,936,968 B2 8/2005 Cross et al.
6,936,978 B2 8/2005 Morgan et al.
6,940,230 B2 9/2005 Myron et al.
6,948,829 B2 9/2005 Verdes et al.
6,957,905 B1 10/2005 Pritchard et al.
6,963,175 B2 11/2005 Archenhold et al.
6,964,501 B2 11/2005 Ryan
6,965,197 B2 11/2005 Tyan et al.
6,965,205 B2 11/2005 Piepgras et al.
6,967,448 B2 11/2005 Morgan et al.
6,969,179 B2 11/2005 Sloan et al.
6,969,186 B2 11/2005 Sonderegger et al.
6,969,954 B2 11/2005 Lys
6,975,079 B2 12/2005 Lys et al.
6,979,097 B2 12/2005 Elam et al.

6,982,518 B2 1/2006 Chou et al.
6,995,681 B2 2/2006 Pederson
6,997,576 B1 2/2006 Lodhie et al.
7,004,603 B2 2/2006 Knight
D518,218 S 3/2006 Roberge et al.
7,008,079 B2 3/2006 Smith
7,014,336 B1 3/2006 Ducharme et al.
7,015,650 B2 3/2006 McGrath
7,018,063 B2 3/2006 Michael et al.
7,021,799 B2 4/2006 Mizuyoshi
7,021,809 B2 4/2006 Iwasa et al.
7,024,256 B2 4/2006 Krzyzanowski et al.
7,031,920 B2 4/2006 Dowling et al.
7,033,036 B2 4/2006 Pederson
7,038,398 B1 5/2006 Lys et al.
7,038,399 B2 5/2006 Lys et al.
7,042,172 B2 5/2006 Dowling et al.
7,048,423 B2 5/2006 Stepanenko et al.
7,049,761 B2 5/2006 Timmermans et al.
7,052,171 B1 5/2006 Lefebvre et al.
7,053,557 B2 5/2006 Cross et al.
7,064,498 B2 6/2006 Dowling et al.
7,064,674 B2 6/2006 Pederson
7,067,992 B2 6/2006 Leong et al.
7,077,978 B2 7/2006 Setlur et al.
7,080,927 B2 7/2006 Feuerborn et al.
7,086,747 B2 8/2006 Nielson et al.
7,088,014 B2 8/2006 Nierlich et al.
7,088,904 B2 8/2006 Ryan, Jr.
7,102,902 B1 9/2006 Brown et al.
7,113,541 B1 9/2006 Lys et al.
7,114,830 B2 10/2006 Robertson et al.
7,114,834 B2 10/2006 Rivas et al.
7,118,262 B2 10/2006 Negley
7,119,503 B2 10/2006 Kemper
7,121,679 B2 10/2006 Fujimoto
7,122,976 B1 10/2006 Null et al.
7,128,442 B2 10/2006 Lee et al.
7,128,454 B2 10/2006 Kim et al.
D532,532 S 11/2006 Maxik
7,132,635 B2 11/2006 Dowling
7,132,785 B2 11/2006 Ducharme
7,132,804 B2 11/2006 Lys et al.
7,135,824 B2 11/2006 Lys et al.
7,139,617 B1 11/2006 Morgan et al.
7,144,135 B2 12/2006 Martin et al.
7,153,002 B2 12/2006 Kim et al.
7,161,311 B2 1/2007 Mueller et al.
7,161,313 B2 1/2007 Piepgras et al.
7,161,556 B2 1/2007 Morgan et al.
7,164,110 B2 1/2007 Pitigoi-Aron et al.
7,164,235 B2 1/2007 Ito et al.
7,165,863 B1 1/2007 Thomas et al.
7,165,866 B2 1/2007 Li
7,167,777 B2 1/2007 Budike, Jr.
7,168,843 B2 1/2007 Striebel
D536,468 S 2/2007 Crosby
7,178,941 B2 2/2007 Roberge et al.
7,180,252 B2 2/2007 Lys et al.
D538,950 S 3/2007 Maxik
D538,952 S 3/2007 Maxik et al.
D538,962 S 3/2007 Elliott
7,186,003 B2 3/2007 Dowling et al.
7,186,005 B2 3/2007 Hulse
7,187,141 B2 3/2007 Mueller et al.
7,190,126 B1 3/2007 Paton
7,192,154 B2 3/2007 Becker
7,198,387 B1 4/2007 Gloisten et al.
7,201,491 B2 4/2007 Bayat et al.
7,201,497 B2 4/2007 Weaver, Jr. et al.
7,202,613 B2 4/2007 Morgan et al.
7,204,615 B2 4/2007 Arik et al.
7,204,622 B2 4/2007 Dowling et al.
7,207,696 B1 4/2007 Lin
7,210,818 B2 5/2007 Luk et al.
7,210,957 B2 5/2007 Mrakovich
7,211,959 B1 5/2007 Chou
7,213,934 B2 5/2007 Zarian et al.
7,217,004 B2 5/2007 Park et al.
7,217,012 B2 5/2007 Southard et al.
7,217,022 B2 5/2007 Ruffin
7,218,056 B1 5/2007 Harwood
7,218,238 B2 5/2007 Right et al.
7,220,015 B2 5/2007 Dowling
7,220,018 B2 5/2007 Crabb et al.
7,221,104 B2 5/2007 Lys et al.
7,221,110 B2 5/2007 Sears et al.
7,224,000 B2 5/2007 Aanegola et al.
7,226,189 B2 6/2007 Lee et al.
7,228,052 B1 6/2007 Lin
7,228,190 B2 6/2007 Dowling et al.
7,231,060 B2 6/2007 Dowling et al.
7,233,115 B2 6/2007 Lys
7,233,831 B2 6/2007 Blackwell
7,236,366 B2 6/2007 Chen
7,237,924 B2 7/2007 Martineau et al.
7,237,925 B2 7/2007 Mayer et al.
7,239,532 B1 7/2007 Hsu et al.
7,241,038 B2 7/2007 Naniwa et al.
7,242,152 B2 7/2007 Dowling et al.
7,246,926 B2 7/2007 Harwood
7,246,931 B2 7/2007 Hsieh et al.
7,248,239 B2 7/2007 Dowling et al.
7,249,269 B1 7/2007 Motoyama
7,249,865 B2 7/2007 Robertson
D548,868 S 8/2007 Roberge et al.
7,252,408 B2 8/2007 Mazzochette et al.
7,253,566 B2 8/2007 Lys et al.
7,255,457 B2 8/2007 Ducharme et al.
7,255,460 B2 8/2007 Lee
7,256,554 B2 8/2007 Lys
7,258,458 B2 8/2007 Mochiachvili et al.
7,258,467 B2 8/2007 Saccomanno et al.
7,259,528 B2 8/2007 Pilz
7,262,439 B2 8/2007 Setlur et al.
7,264,372 B2 9/2007 Maglica
7,267,467 B2 9/2007 Wu et al.
7,270,443 B2 9/2007 Kurtz et al.
7,271,794 B1 9/2007 Cheng et al.
7,273,300 B2 9/2007 Mrakovich
7,274,045 B2 9/2007 Chandran et al.
7,274,160 B2 9/2007 Mueller et al.
D553,267 S 10/2007 Yuen
7,285,801 B2 10/2007 Eliashevich et al.
7,288,902 B1 10/2007 Melanson
7,296,912 B2 11/2007 Beauchamp
7,300,184 B2 11/2007 Ichikawa et al.
7,300,192 B2 11/2007 Mueller et al.
D556,937 S 12/2007 Ly
D557,854 S 12/2007 Lewis
7,303,300 B2 12/2007 Dowling et al.
7,306,353 B2 12/2007 Popovich et al.
7,307,391 B2 12/2007 Shan
7,308,296 B2 12/2007 Lys et al.
7,309,965 B2 12/2007 Dowling et al.
7,318,658 B2 1/2008 Wang et al.
7,319,244 B2 1/2008 Liu et al.
7,319,246 B2 1/2008 Soules et al.
7,321,191 B2 1/2008 Setlur et al.
7,326,964 B2 2/2008 Lim et al.
7,327,281 B2 2/2008 Hutchison
7,329,031 B2 2/2008 Liaw et al.
D563,589 S 3/2008 Hariri et al.
7,345,320 B2 3/2008 Dahm
7,348,604 B2 3/2008 Matheson
7,350,936 B2 4/2008 Ducharme et al.
7,350,952 B2 4/2008 Nishigaki
7,352,138 B2 4/2008 Lys et al.
7,352,339 B2 4/2008 Morgan et al.
7,353,071 B2 4/2008 Blackwell et al.
7,358,679 B2 4/2008 Lys et al.
7,358,929 B2 4/2008 Mueller et al.
7,374,327 B2 5/2008 Schexnaider
7,385,359 B2 6/2008 Dowling et al.
7,391,159 B2 6/2008 Harwood
7,396,146 B2 7/2008 Wang
7,401,935 B2 7/2008 VanderSchuit
7,401,945 B2 7/2008 Zhang 7,427,840 B2 9/2008 Morgan et al.
7,429,117 B2 9/2008 Pohlert et al.
7,434,964 B1 10/2008 Zheng et al.
7,438,441 B2 10/2008 Sun et al.
D580,089 S 11/2008 Ly et al.
D581,556 S 11/2008 To et al.
7,449,847 B2 11/2008 Schanberger et al.
D582,577 S 12/2008 Yuen
D584,428 S 1/2009 Li et al.
7,476,002 B2 1/2009 Wolf et al.
7,476,004 B2 1/2009 Chan
7,478,924 B2 1/2009 Robertson
D586,484 S 2/2009 Liu et al.
D586,928 S 2/2009 Liu et al.
7,490,957 B2 2/2009 Leong et al.
7,497,596 B2 3/2009 Ge
7,507,001 B2 3/2009 Kit
7,510,299 B2 3/2009 Timmermans et al.
7,520,635 B2 4/2009 Wolf et al.
7,521,872 B2 4/2009 Bruning
7,524,089 B2 4/2009 Park
D592,766 S 5/2009 Zhu et al.
D593,223 S 5/2009 Komar
7,530,701 B2 * 5/2009 Chan-Wing ..... 362/17
7,534,002 B2 5/2009 Yamaguchi et al.
7,549,769 B2 6/2009 Kim et al.
7,556,396 B2 7/2009 Kuo et al.
7,572,030 B2 8/2009 Booth et al.
7,575,339 B2 8/2009 Hung
7,579,786 B2 8/2009 Soos
7,583,035 B2 9/2009 Shteynberg et al.
7,602,559 B2 10/2009 Jang et al.
7,619,366 B2 11/2009 Diederiks
7,635,201 B2 12/2009 Deng
7,639,517 B2 12/2009 Zhou et al.
D612,528 S 3/2010 McGrath et al.
7,690,813 B2 4/2010 Kanamori et al.
7,710,047 B2 5/2010 Shteynberg et al.
7,712,918 B2 5/2010 Siemiet et al.
7,828,471 B2 11/2010 Lin
7,843,150 B2 11/2010 Wang et al.
2001/0033488 A1 10/2001 Chliwnyj et al.
2001/0045803 A1 11/2001 Cencur
2002/0011801 A1 1/2002 Chang
2002/0038157 A1 3/2002 Dowling et al.
2002/0044066 A1 4/2002 Dowling et al.
2002/0047569 A1 4/2002 Dowling et al.
2002/0047624 A1 4/2002 Stam et al.
2002/0047628 A1 4/2002 Morgan et al.
2002/0048169 A1 4/2002 Dowling et al.
2002/0057061 A1 5/2002 Mueller et al.
2002/0060526 A1 5/2002 Timmermans et al.
2002/0070688 A1 6/2002 Dowling et al.
2002/0074559 A1 6/2002 Dowling et al.
2002/0078221 A1 6/2002 Blackwell et al.
2002/0101197 A1 8/2002 Lys et al.
2002/0113555 A1 8/2002 Lys et al.
2002/0130627 A1 9/2002 Morgan et al.
2002/0145394 A1 10/2002 Morgan et al.
2002/0145869 A1 10/2002 Dowling
2002/0152045 A1 10/2002 Dowling et al.
2002/0152298 A1 10/2002 Kikta et al.
2002/0153851 A1 10/2002 Morgan et al.
2002/0158583 A1 10/2002 Lys et al.
2002/0163316 A1 11/2002 Lys et al.
2002/0171365 A1 11/2002 Morgan et al.
2002/0171377 A1 11/2002 Mueller et al.
2002/0171378 A1 11/2002 Morgan et al.
2002/0176259 A1 11/2002 Ducharme
2002/0179816 A1 12/2002 Haines et al.
2002/0195975 A1 12/2002 Schanberger et al.
2003/0011538 A1 1/2003 Lys et al.
2003/0028260 A1 2/2003 Blackwell
2003/0031015 A1 2/2003 Ishibashi
2003/0057884 A1 3/2003 Dowling et al.
2003/0057886 A1 3/2003 Lys et al.
2003/0057887 A1 3/2003 Dowling et al.
2003/0057890 A1 3/2003 Lys et al.
2003/0076281 A1 4/2003 Morgan et al.
2003/0085710 A1 5/2003 Bourgault et al.
2003/0095404 A1 5/2003 Becks et al.
2003/0100837 A1 5/2003 Lys et al.
2003/0102810 A1 6/2003 Cross et al.
2003/0133292 A1 7/2003 Mueller et al.
2003/0137258 A1 7/2003 Piepgras et al.
2003/0185005 A1 10/2003 Sommers et al.
2003/0185014 A1 10/2003 Gloisten
2003/0189412 A1 10/2003 Cunningham
2003/0222587 A1 12/2003 Dowling, Jr. et al.
2004/0003545 A1 1/2004 Gillespie
2004/0012959 A1 1/2004 Robertson et al.
2004/0036006 A1 2/2004 Dowling
2004/0037088 A1 2/2004 English et al.
2004/0052076 A1 3/2004 Mueller et al.
2004/0062041 A1 4/2004 Cross et al.
2004/0075572 A1 4/2004 Buschmann et al.
2004/0080960 A1 4/2004 Wu
2004/0090191 A1 5/2004 Mueller et al.
2004/0090787 A1 5/2004 Dowling et al.
2004/0105261 A1 6/2004 Ducharme et al.
2004/0105264 A1 6/2004 Spero
2004/0113568 A1 6/2004 Dowling et al.
2004/0116039 A1 6/2004 Mueller et al.
2004/0124782 A1 7/2004 Yu
2004/0130909 A1 7/2004 Mueller et al.
2004/0141321 A1 7/2004 Dowling et al.
2004/0155609 A1 8/2004 Lys et al.
2004/0160199 A1 8/2004 Morgan et al.
2004/0178751 A1 9/2004 Mueller et al.
2004/0189218 A1 9/2004 Leong et al.
2004/0189262 A1 9/2004 McGrath
2004/0212320 A1 10/2004 Dowling et al.
2004/0212321 A1 10/2004 Lys et al.
2004/0212993 A1 10/2004 Morgan et al.
2004/0223328 A1 11/2004 Lee et al.
2004/0240890 A1 12/2004 Lys et al.
2004/0251854 A1 12/2004 Matsuda et al.
2004/0257007 A1 12/2004 Lys et al.
2005/0013133 A1 1/2005 Yeh
2005/0024877 A1 2/2005 Frederick
2005/0030744 A1 2/2005 Ducharme et al.
2005/0035728 A1 2/2005 Schanberger et al.
2005/0036300 A1 2/2005 Dowling et al.
2005/0040774 A1 2/2005 Mueller et al.
2005/0041161 A1 2/2005 Dowling et al.
2005/0041424 A1 2/2005 Ducharme
2005/0043907 A1 2/2005 Eckel et al.
2005/0044617 A1 3/2005 Mueller et al.
2005/0047132 A1 3/2005 Dowling et al.
2005/0047134 A1 3/2005 Mueller et al.
2005/0062440 A1 3/2005 Lys et al.
2005/0063194 A1 3/2005 Lys et al.
2005/0078477 A1 4/2005 Lo
2005/0099824 A1 5/2005 Dowling et al.
2005/0107694 A1 5/2005 Jansen et al.
2005/0110384 A1 5/2005 Peterson
2005/0116667 A1 6/2005 Mueller et al.
2005/0128751 A1 6/2005 Roberge et al.
2005/0141225 A1 6/2005 Striebel
2005/0151489 A1 7/2005 Lys et al.
2005/0151663 A1 7/2005 Tanguay
2005/0154494 A1 7/2005 Ahmed
2005/0174473 A1 8/2005 Morgan et al.
2005/0174780 A1 8/2005 Park
2005/0184667 A1 8/2005 Sturman et al.
2005/0201112 A1 9/2005 Machi et al.
2005/0206529 A1 9/2005 St.-Germain
2005/0213320 A1 9/2005 Kazuhiro et al.
2005/0213352 A1 9/2005 Lys
2005/0213353 A1 9/2005 Lys
2005/0218838 A1 10/2005 Lys
2005/0218870 A1 10/2005 Lys
2005/0219860 A1 10/2005 Schexnaider
2005/0219872 A1 10/2005 Lys
2005/0225979 A1 10/2005 Robertson et al.
2005/0231133 A1 10/2005 Lys
2005/0236029 A1 10/2005 Dowling
2005/0236998 A1 10/2005 Mueller et al.

2005/0248299 A1 11/2005 Chemel et al.
2005/0253533 A1 11/2005 Lys et al.
2005/0259424 A1 11/2005 Zampini, II et al.
2005/0265019 A1 12/2005 Sommers et al.
2005/0275626 A1 12/2005 Mueller et al.
2005/0276051 A1 12/2005 Caudle et al.
2005/0276053 A1 12/2005 Nortrup et al.
2005/0276064 A1 12/2005 Wu et al.
2005/0285547 A1 12/2005 Piepgras et al.
2006/0002110 A1 1/2006 Dowling et al.
2006/0012987 A9 1/2006 Ducharme et al.
2006/0012997 A1 1/2006 Catalano et al.
2006/0016960 A1 1/2006 Morgan et al.
2006/0022214 A1 2/2006 Morgan et al.
2006/0028155 A1 2/2006 Young
2006/0028837 A1 2/2006 Mrakovich
2006/0034078 A1 2/2006 Kovacik et al.
2006/0050509 A9 3/2006 Dowling et al.
2006/0050514 A1 3/2006 Opolka
2006/0076908 A1 4/2006 Morgan et al.
2006/0092640 A1 5/2006 Li
2006/0098077 A1 5/2006 Dowling
2006/0104058 A1 5/2006 Chemel et al.
2006/0109648 A1 5/2006 Trenchard et al.
2006/0109649 A1 5/2006 Ducharme et al.
2006/0109661 A1 5/2006 Coushaine et al.
2006/0126325 A1 6/2006 Lefebvre et al.
2006/0126338 A1 6/2006 Mighetto
2006/0132061 A1 6/2006 McCormick et al.
2006/0132323 A1 6/2006 Grady, Jr.
2006/0146531 A1 7/2006 Reo et al.
2006/0152172 A9 7/2006 Mueller et al.
2006/0158881 A1 7/2006 Dowling
2006/0170376 A1 8/2006 Piepgras et al.
2006/0192502 A1 8/2006 Brown et al.
2006/0193131 A1 8/2006 McGrath et al.
2006/0197661 A1 9/2006 Tracy et al.
2006/0198128 A1 9/2006 Piepgras et al.
2006/0208667 A1 9/2006 Lys et al.
2006/0220595 A1 10/2006 Lu
2006/0221606 A1 10/2006 Dowling
2006/0221619 A1 10/2006 Nishigaki
2006/0232974 A1 10/2006 Lee et al.
2006/0262516 A9 11/2006 Dowling et al.
2006/0262521 A1 11/2006 Piepgras et al.
2006/0262544 A1 11/2006 Piepgras et al.
2006/0262545 A1 11/2006 Piepgras et al.
2006/0273741 A1 12/2006 Stalker, III
2006/0274529 A1 12/2006 Cao
2006/0285325 A1 12/2006 Ducharme et al.
2007/0035255 A1 2/2007 Shuster et al.
2007/0035538 A1 2/2007 Garcia et al.
2007/0035965 A1 2/2007 Holst
2007/0040516 A1 2/2007 Chen
2007/0041220 A1 2/2007 Lynch
2007/0047227 A1 3/2007 Ducharme
2007/0053182 A1 3/2007 Robertson
2007/0053208 A1 3/2007 Justel et al.
2007/0064419 A1 3/2007 Gandhi
2007/0070621 A1 3/2007 Rivas et al.
2007/0070631 A1 3/2007 Huang et al.
2007/0081423 A1 4/2007 Chien
2007/0086754 A1 4/2007 Lys et al.
2007/0086912 A1 4/2007 Dowling et al.
2007/0097678 A1 5/2007 Yang
2007/0109763 A1 5/2007 Wolf et al.
2007/0115658 A1 5/2007 Mueller et al.
2007/0115665 A1 5/2007 Mueller et al.
2007/0120594 A1 5/2007 Balakrishnan et al.
2007/0127234 A1 6/2007 Jervey, III
2007/0133202 A1 6/2007 Huang et al.
2007/0139938 A1 6/2007 Petroski et al.
2007/0145915 A1 6/2007 Roberge et al.
2007/0147046 A1 6/2007 Arik et al.
2007/0152797 A1 7/2007 Chemel et al.
2007/0153514 A1 7/2007 Dowling et al.
2007/0159828 A1 7/2007 Wang
2007/0165402 A1 7/2007 Weaver, Jr. et al.
2007/0173978 A1 7/2007 Fein et al.
2007/0177382 A1 8/2007 Pritchard et al.
2007/0182387 A1 8/2007 Weirich
2007/0188114 A1 8/2007 Lys et al.
2007/0188427 A1 8/2007 Lys et al.
2007/0189026 A1 8/2007 Chemel et al.
2007/0195526 A1 8/2007 Dowling et al.
2007/0195527 A1 8/2007 Russell
2007/0195532 A1 8/2007 Reisenauer et al.
2007/0205712 A1 9/2007 Radkov et al.
2007/0206375 A1 9/2007 Piepgras et al.
2007/0211463 A1 9/2007 Chevalier et al.
2007/0228999 A1 10/2007 Kit
2007/0235751 A1 10/2007 Radkov et al.
2007/0236156 A1 10/2007 Lys et al.
2007/0237284 A1 10/2007 Lys et al.
2007/0240346 A1 10/2007 Li et al.
2007/0241657 A1 10/2007 Radkov et al.
2007/0242466 A1 10/2007 Wu et al.
2007/0247450 A1 10/2007 Lee
2007/0247842 A1 10/2007 Zampini et al.
2007/0247847 A1 10/2007 Villard
2007/0247851 A1 10/2007 Villard
2007/0258231 A1 11/2007 Koerner et al.
2007/0258240 A1 11/2007 Ducharme et al.
2007/0263379 A1 11/2007 Dowling
2007/0274070 A1 11/2007 Wedell
2007/0281520 A1 12/2007 Insalaco et al.
2007/0285926 A1 12/2007 Maxik
2007/0285933 A1 12/2007 Southard et al.
2007/0290625 A1 12/2007 He et al.
2007/0291483 A1 12/2007 Lys
2007/0296350 A1 12/2007 Maxik et al.
2008/0003664 A1 1/2008 Tysoe et al.
2008/0007945 A1 1/2008 Kelly et al.
2008/0012502 A1 1/2008 Lys
2008/0012506 A1 1/2008 Mueller et al.
2008/0013316 A1 1/2008 Chiang
2008/0013324 A1 1/2008 Yu
2008/0018261 A1 1/2008 Kastner
2008/0024067 A1 1/2008 Ishibashi
2008/0037226 A1 2/2008 Shin et al.
2008/0037245 A1 2/2008 Chan
2008/0037284 A1 2/2008 Rudisill
2008/0062680 A1 3/2008 Timmermans et al.
2008/0089075 A1 4/2008 Hsu
2008/0092800 A1 4/2008 Smith et al.
2008/0093615 A1 4/2008 Lin et al.
2008/0093998 A1 4/2008 Dennery et al.
2008/0094837 A1 4/2008 Dobbins et al.
2008/0130267 A1 6/2008 Dowling et al.
2008/0151535 A1 6/2008 de Castris
2008/0158871 A1 7/2008 McAvoy et al.
2008/0158887 A1 7/2008 Zhu et al.
2008/0164826 A1 7/2008 Lys
2008/0164827 A1 7/2008 Lys
2008/0164854 A1 7/2008 Lys
2008/0175003 A1 7/2008 Tsou et al.
2008/0180036 A1 7/2008 Garrity et al.
2008/0186704 A1 8/2008 Chou et al.
2008/0192436 A1 8/2008 Peng et al.
2008/0198598 A1 8/2008 Ward
2008/0211386 A1 9/2008 Choi et al.
2008/0211419 A1 9/2008 Garrity
2008/0218993 A1 9/2008 Li
2008/0224629 A1 9/2008 Melanson
2008/0224636 A1 9/2008 Melanson
2008/0253125 A1 10/2008 Kang et al.
2008/0258647 A1 10/2008 Scianna
2008/0285257 A1 11/2008 King
2008/0285266 A1 11/2008 Thomas
2008/0290814 A1 11/2008 Leong et al.
2008/0291675 A1 11/2008 Lin et al.
2008/0315773 A1 12/2008 Pang
2008/0315784 A1 12/2008 Tseng
2009/0002995 A1 1/2009 Lee et al.
2009/0016063 A1 1/2009 Hu
2009/0021140 A1 1/2009 Takasu et al.
2009/0046473 A1 2/2009 Tsai et al.
2009/0052186 A1 2/2009 Xue

| | | | | |
|---|---|---|---|---|
| 2009/0067182 | A1 | 3/2009 | Hsu et al. | |
| 2009/0086492 | A1 | 4/2009 | Meyer | |
| 2009/0091938 | A1 | 4/2009 | Jacobson et al. | |
| 2009/0140285 | A1 | 6/2009 | Lin et al. | |
| 2009/0175041 | A1 | 7/2009 | Yuen et al. | |
| 2009/0185373 | A1 | 7/2009 | Grajcar | |
| 2009/0195186 | A1 | 8/2009 | Guest et al. | |
| 2009/0196034 | A1 | 8/2009 | Gherardini et al. | |
| 2009/0213588 | A1 | 8/2009 | Manes | |
| 2009/0273926 | A1 | 11/2009 | Deng | |
| 2009/0303720 | A1 | 12/2009 | McGrath | |
| 2009/0316408 | A1 | 12/2009 | Villard | |
| 2010/0008085 | A1 | 1/2010 | Ivey et al. | |
| 2010/0019689 | A1 | 1/2010 | Shan | |
| 2010/0027259 | A1 | 2/2010 | Simon et al. | |
| 2010/0033095 | A1 | 2/2010 | Sadwick | |
| 2010/0033964 | A1 | 2/2010 | Choi et al. | |
| 2010/0096992 | A1 | 4/2010 | Yamamoto et al. | |
| 2010/0096998 | A1 | 4/2010 | Beers | |
| 2010/0103664 | A1 | 4/2010 | Simon et al. | |
| 2010/0109550 | A1 | 5/2010 | Huda et al. | |
| 2010/0109558 | A1 | 5/2010 | Chew | |
| 2010/0164404 | A1 | 7/2010 | Shao et al. | |
| 2011/0006658 | A1 * | 1/2011 | Chan et al. | 313/45 |

FOREIGN PATENT DOCUMENTS

| | | | | |
|---|---|---|---|---|
| CN | 2766345 | Y | | 3/2006 |
| CN | 2869556 | Y | | 2/2007 |
| CN | 201129681 | Y | * | 10/2008 |
| CN | 201184574 | Y | * | 1/2009 |
| EP | 0013782 | B1 | | 3/1983 |
| EP | 0091172 | A2 | | 10/1983 |
| EP | 0124924 | B1 | | 9/1987 |
| EP | 0174699 | B1 | | 11/1988 |
| EP | 0197602 | B1 | | 11/1990 |
| EP | 0214701 | B1 | | 3/1992 |
| EP | 0262713 | B1 | | 6/1992 |
| EP | 0203668 | B1 | | 2/1993 |
| EP | 0272749 | B1 | | 8/1993 |
| EP | 0337567 | B1 | | 11/1993 |
| EP | 0390262 | B1 | | 12/1993 |
| EP | 0359329 | B1 | | 3/1994 |
| EP | 0403011 | B1 | | 4/1994 |
| EP | 0632511 | A2 | | 1/1995 |
| EP | 0432848 | B1 | | 4/1995 |
| EP | 0403001 | B1 | | 8/1995 |
| EP | 0525876 | B1 | | 5/1996 |
| EP | 0714556 | B1 | | 1/1999 |
| EP | 0458408 | B1 | | 9/1999 |
| EP | 0578302 | B1 | | 9/1999 |
| EP | 0723701 | B1 | | 1/2000 |
| EP | 0787419 | B1 | | 5/2001 |
| EP | 1195740 | A2 | | 4/2002 |
| EP | 1016062 | B1 | | 8/2002 |
| EP | 1195740 | A3 | | 1/2003 |
| EP | 1149510 | B1 | | 2/2003 |
| EP | 1056993 | B1 | | 3/2003 |
| EP | 0766436 | B1 | | 5/2003 |
| EP | 0924281 | B1 | | 5/2003 |
| EP | 0826167 | B1 | | 6/2003 |
| EP | 1147686 | B1 | | 1/2004 |
| EP | 1142452 | B1 | | 3/2004 |
| EP | 1145602 | B1 | | 3/2004 |
| EP | 1422975 | A1 | | 5/2004 |
| EP | 0890059 | B1 | | 6/2004 |
| EP | 1348319 | B1 | | 6/2005 |
| EP | 1037862 | B1 | | 7/2005 |
| EP | 1346609 | B1 | | 8/2005 |
| EP | 1321012 | B1 | | 12/2005 |
| EP | 1610593 | A2 | | 12/2005 |
| EP | 1624728 | A1 | | 2/2006 |
| EP | 1415517 | B1 | | 5/2006 |
| EP | 1415518 | B1 | | 5/2006 |
| EP | 1438877 | B1 | | 5/2006 |
| EP | 1166604 | B1 | | 6/2006 |
| EP | 1479270 | B1 | | 7/2006 |
| EP | 1348318 | B1 | | 8/2006 |
| EP | 1399694 | B1 | | 8/2006 |
| EP | 1461980 | B1 | | 10/2006 |
| EP | 1110120 | B1 | | 4/2007 |
| EP | 1440604 | B1 | | 4/2007 |
| EP | 1047903 | B1 | | 6/2007 |
| EP | 1500307 | B1 | | 6/2007 |
| EP | 0922305 | B1 | | 8/2007 |
| EP | 0922306 | B1 | | 8/2007 |
| EP | 1194918 | B1 | | 8/2007 |
| EP | 1048085 | B1 | | 11/2007 |
| EP | 1763650 | B1 | | 12/2007 |
| EP | 1776722 | B1 | | 1/2008 |
| EP | 1459599 | B1 | | 2/2008 |
| EP | 1887836 | A2 | | 2/2008 |
| EP | 1579733 | B1 | | 4/2008 |
| EP | 1145282 | B1 | | 7/2008 |
| EP | 1157428 | B1 | | 9/2008 |
| EP | 1000522 | B1 | | 12/2008 |
| EP | 1502483 | B1 | | 12/2008 |
| EP | 1576858 | B1 | | 12/2008 |
| EP | 1646092 | B1 | | 1/2009 |
| EP | 1579736 | B1 | | 2/2009 |
| EP | 1889519 | B1 | | 3/2009 |
| EP | 1537354 | B1 | | 4/2009 |
| EP | 1518445 | B1 | | 5/2009 |
| EP | 1337784 | B1 | | 6/2009 |
| GB | 2215024 | A | | 9/1989 |
| GB | 2324901 | A | | 11/1998 |
| JP | 6-54103 | U | | 7/1994 |
| JP | H6-54103 | | | 7/1994 |
| JP | 7-249467 | | | 9/1995 |
| JP | 08-162677 | | | 6/1996 |
| JP | 11-135274 | A | | 5/1999 |
| JP | 2001-238272 | A | | 8/2001 |
| JP | 2001291406 | A | * | 10/2001 |
| JP | 2002-141555 | A | | 5/2002 |
| JP | 3098271 | U | | 2/2004 |
| JP | 2004119078 | A | | 4/2004 |
| JP | 2004273234 | A | * | 9/2004 |
| JP | 2004-335426 | | | 11/2004 |
| JP | 2005-158363 | A | | 6/2005 |
| JP | 2005-166617 | A | | 6/2005 |
| JP | 2005-347214 | A | | 12/2005 |
| JP | 2006-507641 | A | | 3/2006 |
| JP | 3139714 | U | | 2/2008 |
| JP | 2008186758 | A | | 8/2008 |
| JP | 2008-258124 | A | | 10/2008 |
| JP | 2008293753 | A | | 12/2008 |
| KR | 10-2004-0008244 | A | | 1/2004 |
| KR | 20-0430022 | Y1 | | 11/2006 |
| KR | 10-0781652 | B1 | | 12/2007 |
| KR | 100844538 | B1 | | 7/2008 |
| KR | 100888669 | B1 | | 3/2009 |
| TW | M337036 | | | 7/2008 |
| WO | 9906759 | A1 | | 2/1999 |
| WO | 99/10867 | A1 | | 3/1999 |
| WO | 99/31560 | A2 | | 6/1999 |
| WO | 9945312 | A1 | | 9/1999 |
| WO | 9957945 | A1 | | 11/1999 |
| WO | 00/01067 | A2 | | 1/2000 |
| WO | 02/25842 | A2 | | 3/2002 |
| WO | 02/061330 | A2 | | 8/2002 |
| WO | 02/069306 | A2 | | 9/2002 |
| WO | 02/091805 | A2 | | 11/2002 |
| WO | 02/098182 | A2 | | 12/2002 |
| WO | 02/099780 | A2 | | 12/2002 |
| WO | 03/026358 | A1 | | 3/2003 |
| WO | 03/055273 | A2 | | 7/2003 |
| WO | 03/067934 | A2 | | 8/2003 |
| WO | 03/090890 | A1 | | 11/2003 |
| WO | 03/096761 | A1 | | 11/2003 |
| WO | 2004/021747 | A2 | | 3/2004 |
| WO | 2004/023850 | A2 | | 3/2004 |
| WO | 2004/032572 | A2 | | 4/2004 |
| WO | 2004057924 | A1 | | 7/2004 |
| WO | 2004/100624 | A2 | | 11/2004 |
| WO | 2005031860 | A2 | | 4/2005 |
| WO | 2005/052751 | A2 | | 6/2005 |
| WO | 2005/060309 | A2 | | 6/2005 |
| WO | 2005/084339 | A2 | | 9/2005 |
| WO | 2005/089293 | A2 | | 9/2005 |

| | | | |
|---|---|---|---|
| WO | 2005/089309 | A2 | 9/2005 |
| WO | 2006/023149 | A2 | 3/2006 |
| WO | 2006044328 | A1 | 4/2006 |
| WO | 2006056120 | A1 | 6/2006 |
| WO | 2006/093889 | A2 | 9/2006 |
| WO | 2006/127666 | A2 | 11/2006 |
| WO | 2006/127785 | A2 | 11/2006 |
| WO | 2006/133272 | A2 | 12/2006 |
| WO | 2006137686 | A1 | 12/2006 |
| WO | 2007/081674 | A1 | 7/2007 |
| WO | 2007/094810 | A2 | 8/2007 |
| WO | 2007090292 | A1 | 8/2007 |
| WO | 2008137460 | A2 | 11/2008 |
| WO | 2010/030509 | A2 | 3/2010 |

OTHER PUBLICATIONS

Experiment Electronic Ballast. Electronic Ballast for Fluorescent Lamps [online], Revised Fall of 2007. [Retrieved on Sep. 1, 1997]. Retrieved from Virginia Tech Web Page using Internet <URL: http://www.ece.vt.edu/ece3354/labs/ballast.pdf.>.

Truck-Lite, LEDSelect—LED, Model 35, Clearance & Marker Lighting, [online], [retrieved on Jan. 13, 2000] Retrieved from Truck-Lite Web Page using Internet <URL: http://trucklite.com/leds14.html>.

Truck-Lite, LEDSelect—LED, Super 44, Stop, Turn & Tail Lighting, [online], [retrieved on Jan. 13, 2000] Retrieved from Truck-Lite Web Page using Internet <URL: http://trucklite.com/leds2.html>.

Truck-Lite, LEDSelect—LED, Model 45, Stop, Turn & Tail Lighting [online], [retrieved on Jan. 13, 2000] Retrieved from Truck-Lite Web Page using Internet <URL: http://trucklite.com/leds4.html>.

Telecite Products & Services—Display Options, [online], [retrieved on Jan. 13, 2000] Retrieved from Telecite Web page using Internet <URL: http://www.telecite.com/en/products/options en.htm>.

Traffic Signal Products—Transportation Products Group, [online], [retrieved on Jan. 13, 2000] Retrieved from the Dialight Web Page using Internet <URL: http://www.dialight.com/trans.htm>.

LED Lights, Replacement LED lamps for any incandescent light, [online], [retrieved on Jan. 13, 2000] Retrieved from LED Lights Web Page using Internet <URL: http://www.ledlights.com/replac.htm>.

Ledtronics, Ledtronics Catalog, 1996, p. 10, Ledtronics, Torrance, California.

Piper. The Best Path to Efficiency. Building Operating Management, Trade Press Publishing Company May 2000 [online], [retrieved on Jan. 17, 2008]. Retrieved from Find Articles Web Page using Internet <URL:http://findarticles.com/p/articles/mi_qu3922/is_200005/ai_n8899499/>.

Henson, Keith. The Benefits of Building Systems Integration, Access Control & Security Systems Integration, Oct. 1, 2000, Penton Media. [online], [retrieved on Oct. 24, 2008] Retrieved from Security Solutions Web page using Internet <URL: http://securitysolutions.com/mag/security_benefits_building_systems/>.

Phason Electronic Control Systems, Light Level Controller (LLC) case study. Nov. 30, 2004. 3 pages, Phason Inc., Winnipeg, Manitoba, Canada.

Airport International. Fly High With Intelligent Airport Building and Security Solutions [online], [retrieved on Oct. 24, 2008]. Retrieved from Airport International web page using Internet <URL: http://www.airport-int.com/categories/airport-building-and-security-solutions/fly-high-with-intelligent-airport-building-and-security-solutions.html>.

D.N.A.-III, [online], [retrieved Mar. 10, 2009] Retrieved from the PLC Lighting Web Page using Internet <URL: http://www.plclighting.com/product_info.php?cPath=1&products_id=92>.

E20116-18 Larmes Collection, [online], [retrieved on Jul. 10, 2010] Retrieved from ET2 Contemporary Lighting using Internet <URL: http://www.et2online.com/proddetail.aspx?ItemID=E20116-18>.

E20112-22 Starburst Collection, [online], [retrieved on Jul. 10, 2010] Retrieved from ET2 Contemporary Lighting using Internet <URL: http://www.et2online.com/proddetail.aspx?ItemID=E20112-22>.

E20524-10 & E20525-10 Curva Collection, [online], [retrieved on Jul. 10, 2010] Retrieved from ET2 Contemporary Lighting using Internet <URL: http://www.et2online.com/proddetail.aspx?ItemID=E20524-10 & E20525-10>.

E22201-44 Esprit Collection, [online], [retrieved on Jul. 10, 2010] Retrieved from ET2 Contemporary Lighting using Internet <URL: http://www.et2online.com/proddetail.aspx?ItemID=E22201-44>.

E20743-09 Stealth Collection, [online], [retrieved on Jul. 10, 2010] Retrieved from ET2 Contemporary Lighting using Internet <URL: http://www.et2online.com/proddetail.aspx?ItemID=E20743-09>.

Spencer, Eugene. High Sales, Low Utilization. Green Intelligent Buildings, Feb. 1, 2007. [online]. Retrieved from Green Intelligent Buildings web page using Internet <URL: http://www.greenintelligentbuildings.com/CDA/IBT_Archive/BNP_GUID_9-5-2006_A_1000000000000056772>.

Sensor Switch, nLight Lighting Control System, [online], [retrieved on Jan. 11, 2008] Retrieved from Sensor Switch web page using Internet <URL: http://www.sensorswitch.com>.

Six Strategies, [online], [retrieved on Jan. 11, 2008] Retrieved from Encelium Technologies Inc. Web Page using Internet <URL: http://www.enceliurn.com/products/strategies.html>.

Lawrence Berkeley National Labratory. Lighting Control System—Phase Cut Carrier. University of California, [online] [retrieved on Jan. 14, 2008] Retrieved from Lawrence Berkeley National Labratory web page using Internet <URL: http://www.lbl.gov/tt/techs/lbnl1871.html>.

Best Practice Guide—Commercial Office Buildings—Central HVAC System. [online], [Retrieved on Jan. 17, 2008] Retrieved from Flex Your Power Organization web page using Internet <URL: http://www.fypower.org/bpg/module.html?b=offices&m+Central HVAC Systems&s=Contr...>.

Cornell University. Light Canopy—Cornell University Solar Decathlon, [online], [retrieved on Jan. 17, 2008] Retrieved from Cornell University web page using Internet <URL: http://cusd.cornell.edu/cusd/web/index.php/page/show/section/Design/page/controls>.

PLC-96973-PC PLC Lighting Elegance Modern/Contemporary Pendant Light, [online], [retrieved on Feb. 27, 2009] Retrieved from the Arcadian Lighting Web Page using Internet <URL: http/www.arcadianlighting.com/plc-96978-pc.html>.

PLC-81756-AL "Fireball" Contemporary Pendant Light, [online], [retrieved on Feb. 27, 2009] Retrieved from the Arcadian Lighting Web Page using Internet <URL: http://www.arcadianlighting .com/plc-81756-al.html>.

Philips. Sense and Simplicity—Licensing program for LED Luminaires and Retrofits, Philips Intellectual Property & Standards, May 5, 2009.

International Search Report and Written Opinion dated Dec. 13, 2010 from the corresponding International Application No. PCT/US2010/037006 filed Jun. 2, 2010.

* cited by examiner

SCREW-IN LED BULB COMPRISING A BASE HAVING OUTWARDLY PROJECTING NODES

STATEMENT OF RELATED CASES

This application claims priority to Provisional Application No. 61/183,307 filed Jun. 2, 2009, which is hereby incorporated by reference in its entirety.

BACKGROUND

Incandescent light bulbs are commonly used in many environments, such as households, commercial buildings, and advertisements, and in many types of fixtures, such as desk lamps and overhead fixtures. Incandescent bulbs can have a threaded electrical connector for use in Edison-type fixtures, though incandescent bulbs can include other types of electrical connectors such as a bayonet or pin electrical connector. Incandescent light bulbs generally consume large amounts of energy and have short life-spans. Indeed, many countries have begun phasing out or plan to phase out the use of incandescent light bulbs entirely.

Compact fluorescent light bulbs (CFLs) are gaining popularity as replacements for incandescent light bulbs. CFLs are typically much more energy efficient than incandescent light bulbs, and CFLs typically have much longer life-spans than incandescent light bulbs. However, CFLs contain mercury, a toxic chemical, which makes disposal of CFLs difficult. Additionally, CFLs require a momentary start-up period before producing light, and many consumers do not find CFLs to produce light of similar quality to incandescent bulbs. Further, CFLs are often larger than incandescent lights of similar luminosity, and some consumers find CFLs unsightly when not lit.

Known LED-based light bulbs have been developed as an alternative to both incandescent light bulbs and CFLs. Known LED light bulbs typically each include a base that functions as a heat sink and also include an electrical connector at one end, a group of LEDs attached to the base, and a bulb. The bulb often has a semi-circular shape with its widest portion attached to the base such that the bulb protects the LEDs.

SUMMARY

Known LED-based light bulbs suffer from multiple drawbacks. A base of a typical known LED-based light bulb is unable to dissipate a large amount of heat, which in turn limits the amount of power that can be supplied to LEDs in the known LED-based light bulb without a high risk of the LEDs overheating. As a result of the power supplied to the LEDs being limited, the typical known LED-based light bulb has a limited luminosity and as a result is not as bright as an incandescent light bulb that the LED-based light bulb is intended to replace.

In an effort to increase the luminosity of known LED-based light bulbs, some known LED-based light bulbs include over-sized bases having large surface areas. The large surface areas of the over-sized bases are intended to allow the bases to dissipate sufficient amounts of heat such that the LEDs of each known LED-based light can be provided with enough power to produce as much luminosity as the respective incandescent bulbs that these known LED-based light bulbs are intended to replace. However, the total size of one of the LED-based lights is often limited, such as due to a fixture size constraint. For example, a desk lamp may only be able to accept a bulb having a three to four inch diameter, in which case the over-sized base of an LED-based light should not exceed three to four inches in diameter. Thus, the size of the over-sized base for the known LED-based light bulb is constrained, and heat dissipation remains problematic.

Further, the use of over-sized bases in some known LED-based light bulbs detracts from the distributions of light emanating from the bulbs. That is, for a typical known LED-based light bulb having one of the over-sized bases, the over-sized base has a diameter as large as or larger than a maximum diameter of the bulb of the known LED-based light bulb. As a result of its small bulb diameter to base diameter ratio, the base blocks light that has been reflected by the bulb and that would otherwise travel in a direction toward an electrical connector at an end of the base. The typical known LED-based light bulb thus does not direct much light in a direction toward the electrical connector. For example, when the typical known LED-based light bulb having an over-sized base is installed in a lamp or other fixture in which the bulb is oriented with its base below its bulb, very little light is directed downward. Thus, the use of over-sized bases can also prevent known LED-based lights from closely replicating the distribution of incandescent bulbs.

As an alternative to using over-sized bases, other attempts have been made to increase the ability of known LED-based light bulbs to dissipate heat. For example, bases of some known LED-based light bulbs include motorized fans for increasing the amounts of airflow experienced by the bases. However, known LED-based light bulbs including fans often produce audible noises and are expensive to produce. As another example of an alternative to using an over-sized base, bases of some known LED-based lights have been provided with axially (e.g., if the LED-based light is intended to replace a conventional incandescent bulb, then the axial direction is from an end of the Edison-type connector opposite the bulb along the major length of the bulb to an opposing end of the light) extending ribs in an attempt to increase the surface areas of the bases without too greatly increasing the diameters of the bases. However, such ribs often have the effect of acting as a barrier to air flow and, as a result, tend to stall air flow relative to the base. As a result, bases with axially extending ribs typically do not provide a sufficient amount of heat dissipation.

Examples of a screw-in LED bulb described herein have many advantages over known LED-based light bulbs. For example, an example of a screw-in LED bulb as described herein can include a base with a plurality of nodes, and channels between the nodes can extend about the base in multiple directions, such as axially and circumferentially. The nodes can increase the surface area of the base, thereby improving the conductive heat dissipation abilities of the base, and the geometry of the base can enhance airflow relative to the base, thereby improving the convective heat dissipation abilities of the base. The base can thus dissipate a sufficient amount of energy for the screw-in LED bulb to produce as much light as a known incandescent bulb.

The exact geometry of the base can be determined using, as an example, fluid dynamics software. The material of the base, the amount of heat produced by LEDs in the screw-in LED bulb, and the temperature at which the LEDs safely operate can be among the considerations used to determine the geometry of the base. Additionally, the base can be shaped to improve airflow, thus improving convective heat transfer, and both the speed and direction of airflow can be considered. Airflow at the time the bulb is initially turned on, airflow between the time at which the screw-in LED bulb is initially turned on and the time at which the screw-in LED bulb reaches steady state operation, and airflow at the time at which steady state operation of the screw-in LED bulb has been reached can all be considered to determine the geometry of the base.

Additionally, the nodes can be shaped to allow for easy manufacturing of the base using die casting. A die can be made in sections or pieces, and the die pieces can be arranged to contact one another to form a mold cavity having the shape of the base. Liquid material, e.g., molten aluminum, can be poured into the mold cavity, and the liquid material can be allowed to cool to form the base. The die pieces can be pulled away from the formed base in different directions, such as in four directions angled approximately ninety degrees from one another. Thus, the nodes can be shaped to not interfere with removal of the die pieces.

The geometry of the base relative to a geometry of a bulb of the screw-in LED bulb can be set such that the light distribution from the screw-in LED bulb closely replicates the distribution of light from an incandescent bulb. A maximum width of the bulb measured perpendicularly to an axial direction of the base can be about 120% or more of a maximum diameter of the base, and a height of the bulb measured along the axial direction of the base can be about equal to the maximum width of the bulb or greater than the maximum width of the bulb. These ratios can allow the bulb to distribute light in a direction toward an electrical connector at an end of the base opposite the bulb and for light to disperse prior to contacting the bulb to reduce the appearance of a bright spot. Also, a portion of the bulb that is in the path of a high amount of light can be coated or otherwise modified to reduce its transmissiveness, thereby directing light toward portions of the bulb that would otherwise receive only a low amount of light.

BRIEF DESCRIPTION OF THE DRAWINGS

The description herein makes reference to the accompanying drawings wherein like reference numerals refer to like parts throughout the several views, and wherein.

DESCRIPTION

Figure 1:
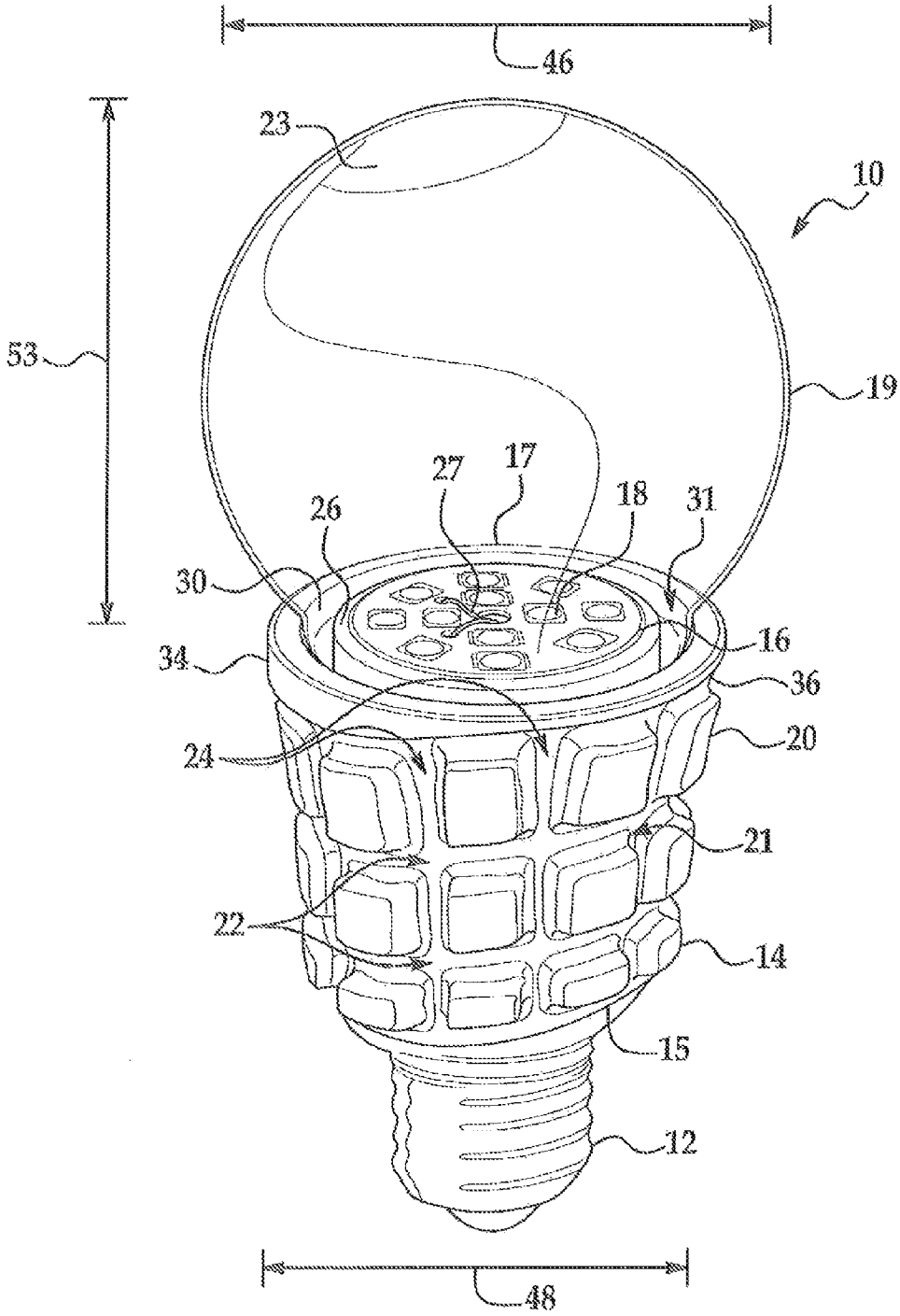
FIG. 1 is a perspective view of a first example of a screw-in LED bulb.

Examples of LED-based light bulbs are discussed herein with reference to FIGS. 1-5. A first example of a screw-in LED bulb 10 shown in FIG. 1 can include an electrical connector 12, a base 14 attached to the electrical connector 12, a circuit board 16 attached to the base 14, a plurality of LEDs 18 mounted on the circuit board 16, and a bulb 19 connected to the base 14 and covering the LEDs 18.

The electrical connector 12 can be of the screw-in type, also referred to as an Edison connector. The electrical connector 12 can alternatively be of another type such as a bayonet connector or pin connector. The electrical connector 12 can serve as an electrical and physical connection between the bulb 10 and a fixture, such as a desk lamp or an overhead fixture. The electrical connector 12 can be screwed, snap-fit, glued, or otherwise attached to a first end 15 of the base 14.

Referring still to FIG. 1, the base 14 can act as a heat sink for dissipating heat produced by the LEDs 18. The base 14 can be made from a highly thermally conductive metal such as aluminum, a highly thermally conductive plastic, or another highly thermally conductive material. How thermally conductive the material from which the base 14 is constructed should be can be determined based on, for example, the amount of heat that is to be dissipated and the geometry of the base 14. The base 14 can be painted, powder-coated, or anodized to improve its thermal emissivity. For example, a thermally conductive, high emissivity paint (e.g., a paint having an emissivity of greater than 0.5) can be applied to at least a portion of an exterior of the base 14.

Figure 5:
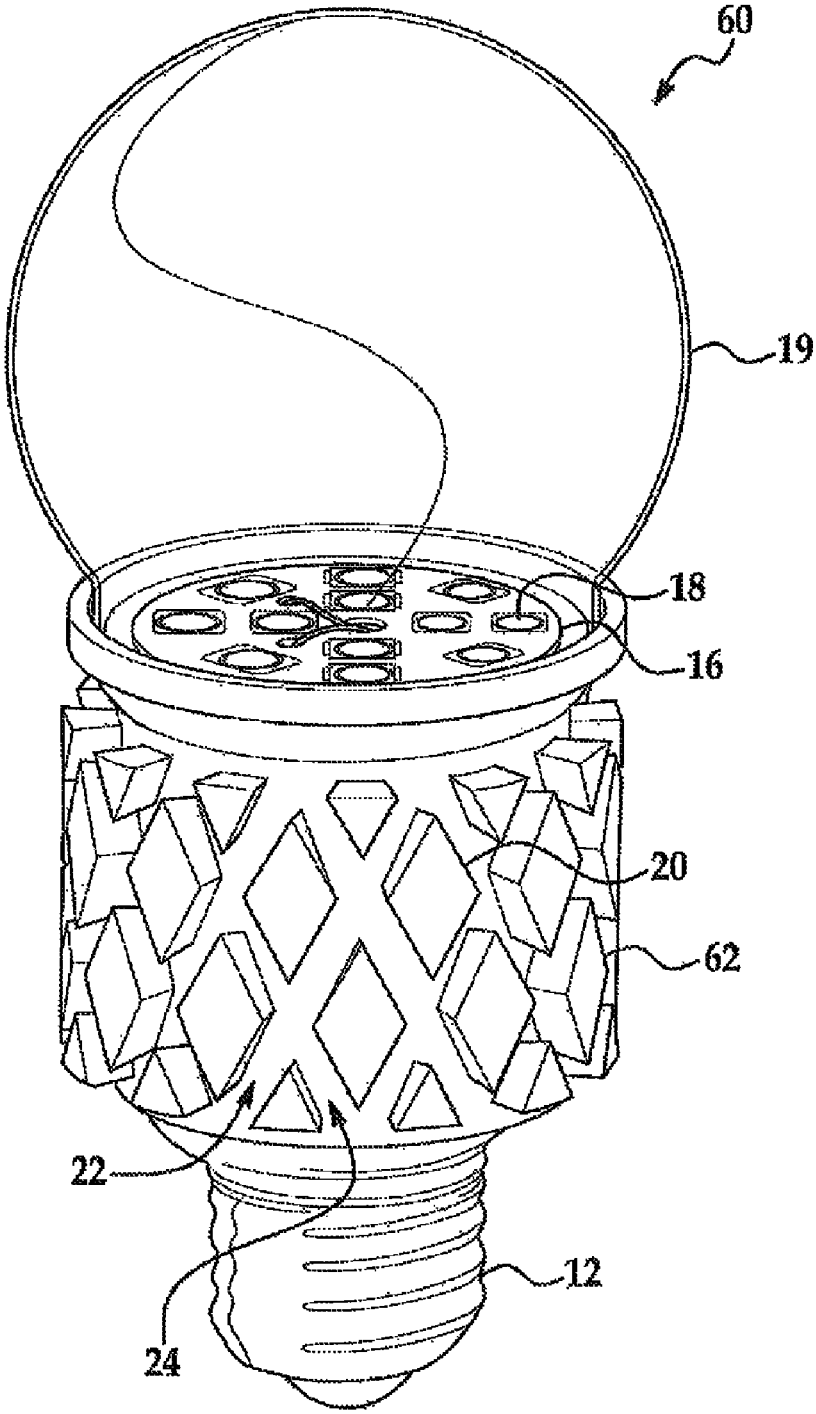
FIG. 5 is a perspective view of a second example of a screw-in LED bulb.

The base 14 can define a plurality of raised nodes 20 projecting radially outward from an exterior surface 21 of the base 14. The nodes 20 can have a generally rectangular shape as shown in FIG. 1, a diamond shape as shown in FIG. 5, or some other shape (e.g., oval, triangular, or polygonal). The nodes 20 can be arranged generally in rows and columns as shown in FIG. 1 to define channels 22 and 24. While the channels 22 and 24 extend generally circumferentially and axially, respectively, relative to the base 14 as shown in FIG. 1, the channels 22 and 24 can be oriented differently depending on the shape and position of the nodes 20. For example, as shown in FIG. 5, the channels 22 and 24 are angled approximately forty five degrees relative the circumferential and axial directions, respectively. The nodes 20 can have rounded edges at the junctions of proximal ends of the nodes 20 and the surface 21, at the junctions between different sides of the nodes 20 that extend between the proximal and distal ends of the nodes 20, and at the junctions between the sides of the nodes 20 and the distal ends of the nodes 20. The rounded edges of the nodes 20 can encourage airflow over the base 14, as rounded edges can enable greater airflow compared to sharp edges by reducing the tendency of air to stall.

Figure 2:
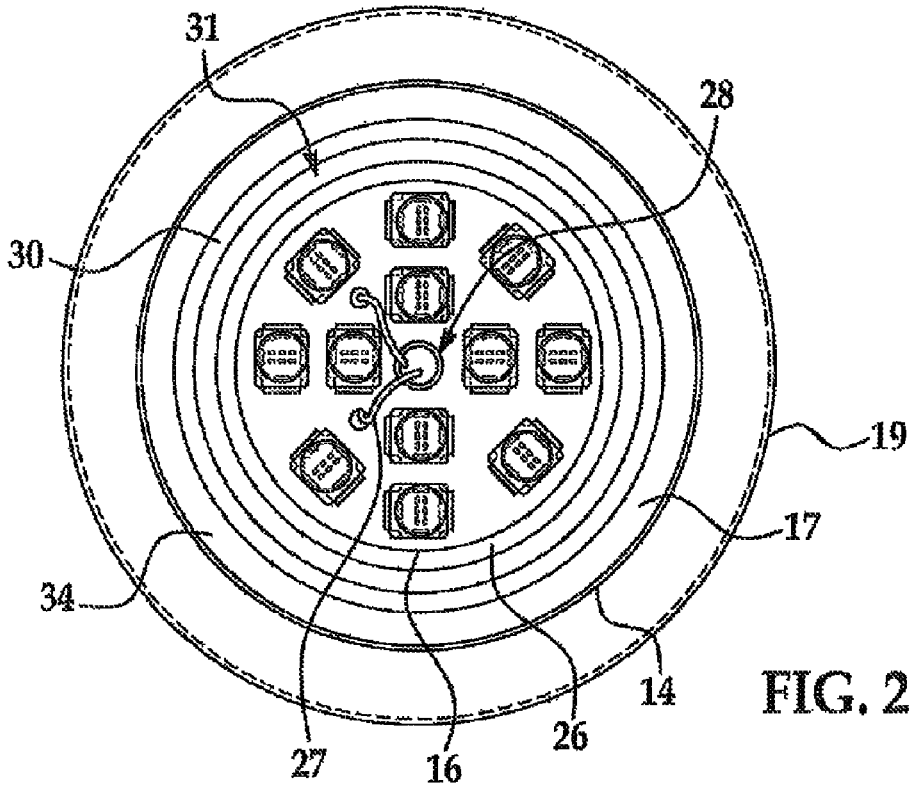
FIG. 2 is a top plan view of the screw-in LED bulb of FIG. 1.

Referring now to FIG. 2, a second end 17 of the base 14 axially opposite the first end 15 can define a platform 26 for receiving the circuit board 16. The platform 26 can be generally planar and can define an aperture 28 through which wiring 27 that is in electrical communication with the electrical connector 12 and the circuit board 16 can pass. A wall 30 can extend circumferentially around the platform 26. While the wall 30 is shown as continuous, the wall 30 can alternatively be discontinuous. The wall 30 can be obtusely angled relative to the platform 26 such that an angle between, for example, 90 and 135 degrees is formed therebetween. The wall 30 can enhance an attachment between the base 14 and bulb 19 by providing a surface to which the bulb 19 can be attached. A recessed groove 31 can be defined by the second end 17 of the base 14 about the platform 26 and radially inward of the wall 30.

Referring again to FIG. 1, a ridge 34 can extend radially outward and axially toward the nodes 20 from the second end 17 of the base 14. The length of the ridge 34 in the axial direction of the base 12 can vary circumferentially around the base 12 as shown in FIG. 1. For example, the axial length of the ridge 34 can vary such that the distance between the ridge 34 and adjacent nodes 20 remains substantially constant around the base 14 even if the positions of the nodes 20 are staggered in the axial direction. A fillet 36 can be included between the ridge 34 and the surface 21 of the base 14 as shown in FIG. 1. The fillet 36 can improve airflow between the ridge 34 and the nodes 20 and surface 21.

Figure 3:
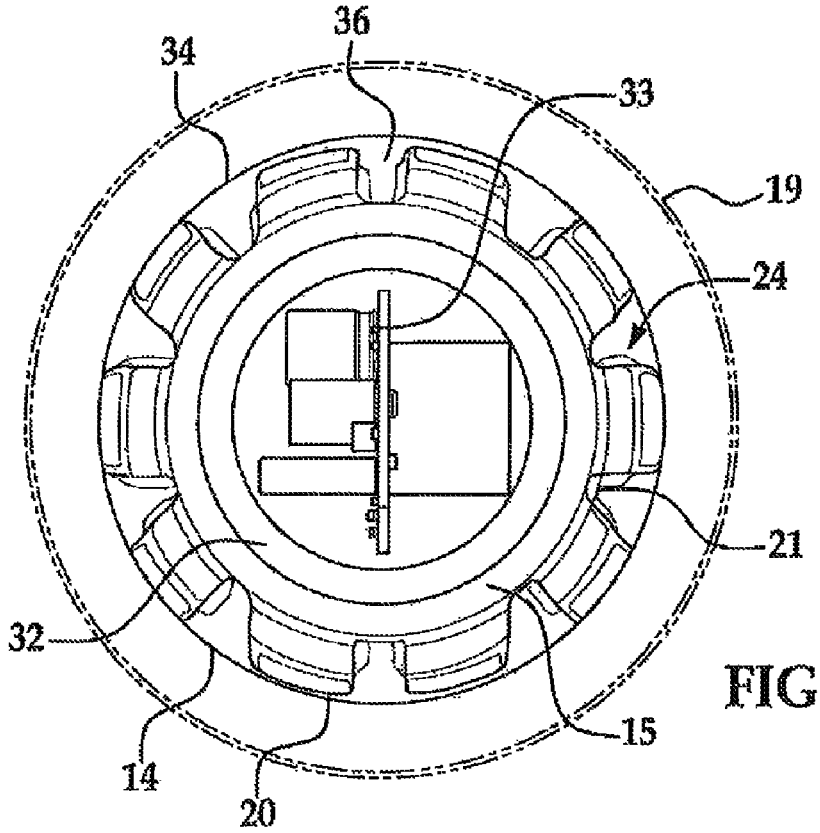
FIG. 3 is a bottom plan view of the screw-in LED bulb of FIG. 1 without its electrical connector and with its bulb shown in phantom.

The base 14 can also define a cavity 32 as shown in FIG. 3. The cavity 32 can be sized to receive electronics 33 that, as an example, convert AC power received from the electrical connector 12 to DC power that is supplied to the LEDs 18. The electronics 33 can be electrically coupled to the electric connector 12, and the wiring 27 can extend from the electronics 33 to the circuit board 16. The electronics 33 can include, for example, a rectifier, a filtering capacitor, and DC to DC conversion circuitry. The electronics 33 can be loosely inserted into the cavity 32 and held in place as a result of the electric connector 12 enclosing the cavity 32. Alternatively, the electronics 33 can be adhered, clipped, or otherwise attached to the base 14. While the illustrated cavity 32 is cylindrical, the cavity 32 can have an alternative shape, such as a conical shape or an oval shape.

Currently, the size of the electronics 33 can be a constraint on the size of the base 14. As an example, a minimum diameter of the base 14 can be constrained such that the base 14 is of sufficient size to define the cavity 32 that in turn is of sufficient size for receiving the electronics 33. Additionally, a maximum size of the base 14, both in terms of its axial length and diameter, can be constrained by a size of a fixture in which the screw-in LED bulb 10 may be installed in. For example, the screw-in LED bulb 10 can be constrained not to exceed the length and diameter of an incandescent light bulb that the screw-in LED bulb 10 is intended to replace. Further, the maximum size of the base 14, also both in terms of its axial length and diameter, can be constrained to achieve a distribution of light that closely replicates a distribution of light from an incandescent bulb as is explained below in greater detail with respect to the ratio between the dimensions of the base 14 and the dimensions of the bulb 19. Whether or not the distribution of light from the screw-in LED bulb 10 closely replicates the distribution of light from an incandescent bulb can be judged by luminosity measuring tools, by the preferences of ordinary users, or in another manner. In addition to the above mentioned constraints, other factor can be taken into consideration when determining the geometry of the base 14, such as the expected amount of heat output by the LEDs 18, a maximum temperature at which the LEDs 18 operate safely, and the material of from which the base 14 is constructed.

Also, when determining the geometry of the base 14, both conductive and convective heat dissipation can be considered. The base 14, or certain portions therefore, can become hotter than ambient air during operation, and as a result air adjacent to hot portions of the base 14 can become hotter than air spaced from the base 14. A temperature gradient between air adjacent to the base 14 and air spaced from the base 14 can result in airflow, which in turn can provide convective heat dissipation that can aid in the dissipation of heat from the base 14. Multiple aspects of convective heat dissipation can be considered when determining the geometry of the base 14, including air speed and airflow direction. Additionally, airflow generated by the temperature gradients explained above can be considered at different time periods when determining the geometry of the base 14, such as when the screw-in LED bulb 10 is turned on, a dynamic period when the screw-in LED bulb 10 is increasing in temperature after being turned on but before reaching a steady state temperature, and when the screw-in LED bulb 10 reaches a steady state temperature. The channels 22 and 24 formed between the nodes 20 can greatly improve convective heat dissipation by allowing airflow in different directions, and the orientation of the channels 22 and 24 can be selected to encourage airflow.

Working under the above-mentioned constraints and considerations, the geometry of the base 14 can be determined such that the base 14 can dissipate a sufficient amount of heat for safe operation of the LEDs 18 at a specified power level (e.g., a power level at which the LEDs 18 produce a sufficient amount of light for the screw-in LED bulb 10 to replicate a certain incandescent bulb, such as a 60 W or 100 W incandescent bulb, that the bulb 10 is to replace). These determinations can be carried out with the use of fluid dynamics software, though hand calculations, experimentation and other manners of making the determinations can be used. If certain areas of the base 14 are determined to become hotter than surrounding areas, more material can be added to the hotter portions of the base 14 within the above mentioned constraints.

In one example in which the bulb 10 was configured to output the same amount of light as a 60 W incandescent bulb, ten columns of nodes 20 are spaced circumferentially around the base 14 and three rows of nodes 20 are spaced axially in each column to achieve sufficient heat dissipation for LEDs 18 of the surface-mountable type available from Nichia to use 11 W of power. Continuing with the example, the nodes 20 occupy approximately 70% of the circumferential surface area of the base 14 excluding the ridge 34, with the surface 21 and ridge 34 occupying the remaining approximately 30% of the circumferential surface area. The nodes 20 have a height of approximately 3 mm from the surface 21. The three nodes 20 in each column have different axial lengths, with the nodes 20 nearest to the platform 26 having an axial length of approximately 10 mm, the middle row of nodes 20 having an axial length of approximately 7 mm, and the nodes 20 nearest the electrical connector 12 having an axial length of approximately 4 mm. The circumferential spacing between the columns of nodes 20 and the axial spacing between the rows of nodes 20 are both approximately 4 mm. The thickness of the base 14 between the surface 21 and the cavity 32 is approximately 2 mm. The diameter of the cavity 32 is approximately 35 mm. Additional geometrical aspects of the base 14 are discussed below in respect of the ratio between the dimensions of the base 14 and the dimensions of the bulb 19. The base 14 can alternatively have a different geometry and still be suitable for use with LEDs 18 of the surface-mountable type available from Nichia that produce 11 W in the aggregate, and the base 14 can have a different geometry if it is intended to replace an incandescent light other than the 60 W incandescent bulb.

Figure 4:
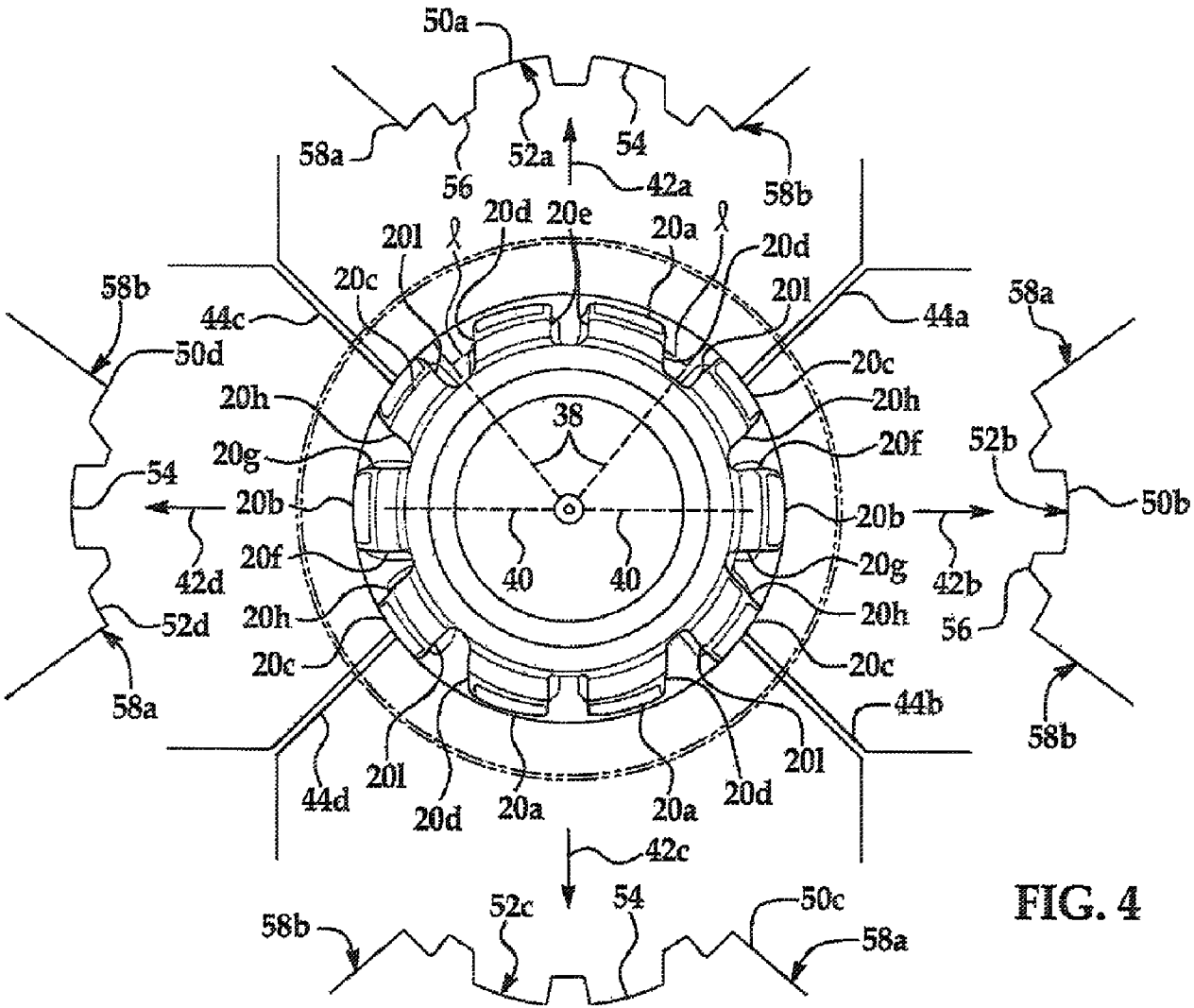
FIG. 4 is a bottom plan view of a base of the screw-in LED bulb of FIG. 1 along with die pieces used to form the base.

The base 14 can be manufactured by die casting, machining (e.g., milling or lathing), or using another process. Referring now to FIG. 4, when die casting the base 14, a die made from die pieces 50*a-d* that collectively define a mold cavity in the shape of the base 14 when assembled can be used. Each die piece 50*a-d* can have a respective face 52*a-d* corresponding to a shape of a portion of the base 14, such as a portion of the base 14 extending the entire axial length of the base 14 and circumferentially approximately a quarter of the circumference of the base 14. Each face 52*a-d* can define a plurality of indentations 54 in the shapes of nodes 20 and can define protrusions 56 that form the channels 22 and 24. Some of the indentations 54 and protrusions 56 can be partially defined by adjacent die pieces 50*a-d* such that those indentations 54 and protrusions 56 are fully defined when the die pieces 50*a-d* are assembled. Molten material can be inserted into the mold cavity and allowed to cool to form the base 14, and the die pieces 50*a-d* can be removed from the base 14 once the molten material is sufficiently cooled.

The geometry of the base 14 can allow for easy removal of the die pieces 50*a-d* from the base 14. For example, as shown in FIG. 4, the die pieces 50*a-d* can meet at junction lines 44*a-d* when assembled to form the complete mold cavity. Each die piece 50*a-d* can have two opposing sides 58*a* and 58*b*, and side 58*a* of each die piece 50*a-d* can contact the side 58*b* of an adjacent die piece 50*a-d* when the die pieces 50*a-d* are assembled. The die pieces 50*a-d* can be removed from the base 14 along respective pull lines 42*a-d* after the molten material poured into the mold cavity has sufficiently cooled to allow removal of the die pieces 50*a-d*.

To allow for removal of the die pieces 50*a-d* after formation of the base 14 without interference from the base 14, at least some of the nodes 20 can project from the surface 21 at an angle relative to radii of the base 14. For example, as shown in FIG. 4, three types of nodes 20*a*, 20*b* and 20*c* can be included on the base 14. Columns of the nodes 20*a* can be included on the base 14 in pairs that are circumferentially adjacent to one another. Two pairs of columns of nodes 20*a* are disposed on the example of the base 14 shown in FIG. 4, with the two pairs of nodes 20*a* being radially opposite one another about the base 14. Sides 20*d* on the circumferential outside of each pair of columns of nodes 20*a* can be angled by an angle $\alpha$ relative to radii 38 of the base 14 that pass through proximal ends of the sides 20*d*. The angles $\alpha$ can be large enough such that sides 20 are parallel to their respective pull lines 42*a* and 42*c* or larger. Sides 20*e* on the circumferential inside of each pair of columns of nodes 20*a* can be parallel to their respective sides 20*d*, or angled toward their respective sides 20*d* to form an acute angle with its vertex radially outward of the nodes 20*a*. Thus, the sides 20*d* and 20*e* of the nodes 20*a* allow die pieces 50*a* and 50*c* to be pulled away along pull lines 42*a* and 42*c*, respectively, without interference from the nodes 20*a*.

Still referring to the example shown in FIG. 4, two columns of nodes 20*b* are included on the base 14 at positions spaced by approximately ninety degrees from the pairs of columns of nodes 20*a*, with the two columns of nodes 20*b* being radially opposite one another relative to the base 14. The nodes 20*b* can have sides 20*f* and 20*g* that are parallel to one another and parallel to radii 40 of the base 14 passing through the circumferential centers of the nodes 20*b*. Sides 20*f* and 20*g* of each node 20*b* can extend generally parallel to a radius 40 of the base 14 passing through the circumferential center of the respective node. Sides 20*f* and 20*g* can be perpendicular to sides 20*d* of the nodes 20*a*. The angles of sides 20*f* and 20*g* allow for die pieces 50*b* and 50*d* to be removed along pull lines 42*b* and 42*d*, respectively, without interference from the nodes 20*b*.

Also in the example shown in FIG. 4, four columns of nodes 20*c* are included on the base 14, with each column of nodes 20*c* positioned circumferentially between one of the columns of nodes 20*a* and one of the columns of nodes 20*b*. Each node 20*c* can have sides 20*h* and 20*i*, with side 20*h* parallel to the nearest side 20*f* or 20*g* of the neighboring node 20*b* or angled away from that nearest side 20*f* or 20*g* as side 20*h* extends radially outward. Similarly, side 20*i* can be parallel to the side 20*d* of its neighboring node 20*a* or angled away from that side 20*d* as side 20*i* extends radially outward. The angles of sides 20*i* and 20*h* can allow die pieces 50*a-d* to be removed from the base 14 without interferences from the nodes 20*b*.

The die section boundaries 44*a*-44*d* can vary from the positions shown in FIG. 4 even if the geometry of the base 14 remains the same. For example, the boundary 44*a* could be moved circumferentially to almost the side 20*i* of the node 20*c* without detrimentally affecting removal of the die pieces 50*a-d*. Also, the angles of the sides 20*d*-20*i* of the nodes 20*a*, 20*b* and 20*c* can vary from as shown in FIG. 3, and the types of nodes 20*a*, 20*b* and 20*c* and number of each type of node 20*a*, 20*b* and 20*c* can vary depending on, for example, the number of columns of nodes 20*a*, 20*b* and 20*c* positioned about the base 14. Also, the number of die pieces 50*a-d* can vary and can be as few as two.

Referring back to FIGS. 1 and 2, the circuit board 16 can be of the type in which metalized conductor patterns are formed in a process known as "printing" to provide electrical connections between the wiring 27 and the LEDs 18 and between the LEDs 18 themselves. The metalized conductor pattern can be printed onto an electrically insulating board or, depending on the material of the base 14, directly onto the base 14. Alternatively, another type of circuit board 16 can be used. The circuit board 16 can be made from one piece or from multiple pieces joined by, for example, bridge connectors. The circuit board 16 can be annular shaped and can extend about the aperture 28 defined by the base 14, though the circuit board 16 can alternatively have a different shape (e.g., a pair of rectangular circuit boards 16 can be attached to the base 14 on radially opposite sides of the aperture 28). The circuit board 16 can be attached to the platform 26 using thermally conductive tape, screws, or another type of connector.

The LEDs 18 can be mounted on the circuit board 16 for electrical communication with the wiring 27. The LEDs 18 can be oriented to produce light centered about axes perpendicular to the platform 26 of the base 14. However, LEDs 18 can additionally or alternatively be oriented at other angles relative to the platform 26. The LEDs 18 can be high-power, white light emitting diodes, such as surface-mount devices of a type available from Nichia. The term "high-power" as used herein refers to LEDs 18 having power ratings of 0.25 watts or more. Indeed, the LEDs 18 can have power ratings of one watt or more. However, LEDs 18 with other power ratings, e.g., 0.05 W, 0.10 W, or 0.25 W, can alternatively be used. The number of LEDs 18 can depend on the intended use of the screw-in LED bulb 10. For example, if the screw-in LED bulb 10 is intended to replace a 60 W incandescent bulb, LEDs 18 with an aggregate power of 11 W can be used to produce a similar luminosity as the 60 W incandescent bulb. Although the LEDs 18 are shown as surface-mounted components, the LEDs 18 can be discrete components. Also, one or more organic LEDs can be used in place of or in addition to the surface-mounted LEDs 18. LEDs 18 that emit blue light, ultra-violet light or other wavelengths of light, such as wavelengths with a frequency of 400-790 THz corresponding to the spectrum of visible light, can alternatively or additionally be included.

The bulb 19 can be attached to the wall 30 of the base 14 using adhesive, though in other examples the bulb 19 can be screwed, snap-fit, or otherwise attached to the base 14. The bulb 19 can be made from a transparent or translucent material such as polycarbonate, acrylic, or glass. The bulb 19 can include a coating 23 to modify the transmissiveness of the bulb 19 by altering paths of light produced by the LEDs 18. The coating 23 can be a reflective coating, a diffusive coating, or another light path altering coating. The coating 23 can be denser on an area of the bulb 19 toward which a large amount of light is directed, such as a portion of the bulb 19 about a line extending axially from a center of the platform 26, compared to areas of the bulb 19 toward which a small amount of light is direct, such as portions of the bulb 19 near the wall 30. The coating 23 can prevent the appearance of a bright spot or a beam of light by scattering light rays and reducing the concentration of light rates in the bright spot area. The coating 23 can direct light in toward directions such as an area of the bulb 19 through which a low amount of light would pass were it not for the coating 23, e.g., an area of the bulb 19 near the wall 30. Alternatively to the coating 23, other types light diffracting structures, such as bumps, ridges, or dimples, can be formed in the bulb 19 at locations where bright spots are present.

Referring still to FIG. 1, the shape of the bulb 19 can affect the distribution of light from the screw-in LED bulb 10. For example, the shape of the bulb 19 can allow the screw-in LED bulb 10 to distribute light relatively evenly in most directions in order for the screw-in LED bulb 10 to closely replicate the appearance of an incandescent bulb. A diameter or width 46 of the bulb 19 measured perpendicularly to the axial direction of the base 14 can be about 120% or more of a maximum diameter 48 of the base 14, which is the diameter of the end 17 of the base 14 as shown in FIG. 1, and a height 53 of the bulb 19 measured along the axial direction of the base 14 from the platform 26 or end 17 of the base 14 can be about equal to the width 46 of the bulb 19 (e.g., the height 53 can be within 10% of the width 46 of the bulb 19) or greater than the width 46 of the bulb 19. Having the bulb 19 extend further than the base 14 in the radial direction as described above allows the bulb 19 to reflect light in directions that would otherwise be blocked by the base 14, such as in a direction toward the electrical connector 12. Having the height 53 of the bulb 19 set about equal to the width 46 of the bulb 19 or greater allows light a sufficient distance to spread out before encountering the bulb 19, which can aid in evening the distribution of light produced by the LEDs 18. Note that these dimensional ratios between the base 14 and the bulb 19 are also affected by the size constraints of the entire screw-in LED bulb 10 mentioned above. The dimensional ratios between the base 14 and bulb 19 can allow the screw-in LED bulb 10 to be positioned, for example, with the bulb 19 above the base 14 in a fixture such as a desk lamp, and the screw-in LED bulb 10 can produce light in a direction toward a desk on which the desk lamp sits.

In one example in which the screw-in LED bulb 10 is intended to replace a 60 W incandescent bulb, the maximum width 46 of the bulb 19 is 67.5 mm and the height of the bulb 19 is 68.5, while the maximum diameter 48 of the base 14 is 54.3 mm. The bulb 19 can have other dimensions when the screw-in LED bulb 10 is intended to replace the 60 W incandescent bulb, or when the screw-in LED bulb 10 is intended to replace some other bulb.

In another example of a screw-in LED bulb 60 shown in FIG. 5 having the same electric connector 12, circuit board 16, LEDs 18, and bulb 19 as the screw-in LED bulb 10, a base 62 defines diamond shaped nodes 20. The diamond shaped nodes 20 on the base 62 define channels 22 and 24 angled approximately forty five degrees relative to the axial and circumferential directions, respectively. The channels 22 and 24 allow airflow to travel in multiple directions, and the base 62 can dissipate a sufficient amount of heat for the LEDs 18 to produce an equivalent amount of light as a 60 W incandescent bulb.

The above-described examples have been described in order to allow easy understanding of the invention and do not limit the invention. On the contrary, the invention is intended to cover various modifications and equivalent arrangements, whose scope is to be accorded the broadest interpretation so as to encompass all such modifications and equivalent structure as is permitted under the law.

What is claimed:

1. An LED-based light comprising:

a highly thermally conductive base defining multiple radially outward projecting nodes, the nodes spaced apart in axial and circumferential directions of the base, the base including recessed channels between the nodes to enable airflow in multiple directions about the base, wherein the nodes project from a surface of the base, and wherein the nodes have filleted edges at junctions between sides of the nodes and the surface and have rounded edges at junctions between sides of the nodes and distal ends of the nodes;

an electrical connector attached to the base;

at least one LED attached to the base; and a light transmitting bulb attached to the base and covering the at least one LED.

2. The LED-based light of claim 1, wherein groups of more than one adjacent nodes are associated with respective imaginary radial pull lines, and wherein sides of each node are angled as the node extends radially outward such that each side extends parallel to its respective pull line or is angled further toward an opposing side of the node than its respective pull line.

3. The LED-based light of claim 1, wherein the nodes are arranged in rows extending circumferentially about the base and in columns extending axially along the base.

4. The LED-based light of claim 1, wherein the channels include a first group of axially extending channels and a second ground of circumferentially extending channels.

5. The LED-based light of claim 1, wherein a width of the bulb in a radial direction perpendicular to the axial direction of the base is at least 20% greater than a width of the base in the radial direction.

6. The LED-based light of claim 1, wherein the width of the bulb is at least 20% greater than a maximum width of the base in the radial direction.

7. The LED-based light of claim 6, wherein a height of the bulb in the axial direction of the base is as at least as great as the width of the bulb.

8. The LED-based light of claim 1, wherein the electrical connector is an Edison-type screw-in connector in electrical communication with the at least one LED.

9. The LED-based light of claim 1, wherein the base defines a cavity for housing electronics configured to convert a power received from the electrical connector to a power suitable for powering the at least one LED.

10. An LED-based light comprising:

a highly thermally conductive base defining multiple radially outward projecting nodes, the nodes spaced apart in axial and circumferential directions of the base, the base including recessed channels between the nodes to enable airflow in multiple directions about the base, wherein the nodes are arranged in rows extending circumferentially about the base and in columns extending axially along the base and wherein the nodes of each row are axially staggered;

an electrical connector attached to the base;

at least one LED attached to the base; and a light transmitting bulb attached to the base and covering the at least one LED.

11. The LED-based light of claim 10, wherein groups of more than one adjacent nodes are associated with respective imaginary radial pull lines, and wherein sides of each node are angled as the node extends radially outward such that each side extends parallel to its respective pull line or is angled further toward an opposing side of the node than its respective pull line.

12. The LED-based light of claim 10, wherein the channels include a first group of axially extending channels and a second ground of circumferentially extending channels.

13. New The LED-based light of claim 10, wherein a width of the bulb in a radial direction perpendicular to the axial direction of the base is at least 20% greater than a width of the base in the radial direction.

14. The LED-based light of claim 13, wherein the width of the bulb is at least 20% greater than a maximum width of the base in the radial direction.

15. The LED-based light of claim 13, wherein a height of the bulb in the axial direction of the base is as at least as great as the width of the bulb.

16. The LED-based light of claim 10, wherein the electrical connector is an Edison-type screw-in connector in electrical communication with the at least one LED.

17. The LED-based light of claim 10, wherein the base defines a cavity for housing electronics configured to convert a power received from the electrical connector to a power suitable for powering the at least one LED.

18. The LED-based light of claim 10, wherein the nodes of each column have different axial lengths.

19. An LED-based light comprising:

a highly thermally conductive base defining multiple radially outward projecting nodes, the nodes spaced apart in axial and circumferential directions of the base, the base including recessed channels between the nodes to enable airflow in multiple directions about the base, wherein the nodes are arranged in rows extending circumferentially about the base and in columns extending axially along the base and wherein the nodes of each column have different axial lengths;

an electrical connector attached to the base;

at least one LED attached to the base; and a light transmitting bulb attached to the base and covering the at least one LED.

20. The LED-based light of claim 19, wherein groups of more than one adjacent nodes are associated with respective imaginary radial pull lines, and wherein sides of each node are angled as the node extends radially outward such that each side extends parallel to its respective pull line or is angled further toward an opposing side of the node than its respective pull line.

21. The LED-based light of claim 19, wherein the channels include a first group of axially extending channels and a second ground of circumferentially extending channels.

22. The LED-based light of claim 19, wherein a width of the bulb in a radial direction perpendicular to the axial direction of the base is at least 20% greater than a width of the base in the radial direction.

23. The LED-based light of claim 22, wherein the width of the bulb is at least 20% greater than a maximum width of the base in the radial direction.

24. The LED-based light of claim 22, wherein a height of the bulb in the axial direction of the base is as at least as great as the width of the bulb.

25. The LED-based light of claim 19, wherein the electrical connector is an Edison-type screw-in connector in electrical communication with the at least one LED.

26. The LED-based light of claim 19, wherein the base defines a cavity for housing electronics configured to convert a power received from the electrical connector to a power suitable for powering the at least one LED.

27. The LED-based light of claim 19, wherein the nodes of each row are axially staggered.

* * * * *